US007500287B2

(12) United States Patent
Brüstle

(10) Patent No.: US 7,500,287 B2
(45) Date of Patent: Mar. 10, 2009

(54) ACTUATING MECHANISM FOR A PIVOTABLY MOUNTED ACTUATING ARM

(75) Inventor: Klaus Brüstle, Höchst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 11/651,472

(22) Filed: Jan. 10, 2007

(65) Prior Publication Data

US 2007/0124893 A1 Jun. 7, 2007

Related U.S. Application Data

(63) Continuation of application No. PCT/AT2005/000142, filed on Apr. 27, 2005.

(30) Foreign Application Priority Data

Jul. 14, 2004 (AT) ..... A 1190/2004
Nov. 8, 2004 (AT) ..... A 1859/2004

(51) Int. Cl.
*E05F 1/08* (2006.01)

(52) U.S. Cl. ..... 16/286; 16/289

(58) Field of Classification Search ..... 16/286–289, 16/370, 371, 331, 322, 325, 327; 49/386, 49/387, 254, 255, 246; 312/322–325, 319.1, 312/319.4; 74/89.18
See application file for complete search history.

(56) References Cited

U.S. PATENT DOCUMENTS 3,088,727 A * 5/1963 Pelagatti ..... 74/89.18
4,452,015 A 6/1984 Jacques et al.
4,817,240 A 4/1989 Sovis, Jr. et al.
5,530,993 A * 7/1996 Hayakawa ..... 16/332
5,904,411 A 5/1999 Hayakawa
5,971,514 A 10/1999 Hayakawa
6,463,627 B1 * 10/2002 Hirtsiefer ..... 16/286
7,178,202 B2 * 2/2007 Hirtsiefer et al. ..... 16/366
2001/0039762 A1 11/2001 Giovannetti
2002/0108311 A1 * 8/2002 Salice ..... 49/371
2002/0189052 A1 12/2002 Melhuish
2006/0279092 A1 * 12/2006 Hirtsiefer ..... 292/262

FOREIGN PATENT DOCUMENTS

DE 1 816 417 1/1971
DE 39 30 609 3/1991
DE 299 07 099 7/1999
DE 102 03 269 8/2003

(Continued)

OTHER PUBLICATIONS

European Search Report issued Nov. 5, 2008 in connection with corresponding European Application No. 08 01 6259.

*Primary Examiner*—Chuck Y. Mah
(74) *Attorney, Agent, or Firm*—Wenderoth, Lind & Ponack, L.L.P.

(57) ABSTRACT

The invention relates to an actuating mechanism for a swivel-mounted actuating arm, especially for driving a lid of an item of furniture. Said mechanism comprises a spring device including a biased actuating element and a translatory mechanism which translates the movement of the actuating element into a swiveling movement of the actuating arm. Said translatory mechanism comprises at least one adjusting device for varying the translation ratio between the movement of the actuating element and the swiveling movement of the actuating arm.

28 Claims, 24 Drawing Sheets

FOREIGN PATENT DOCUMENTS

| | | |
|---|---|---|
| EP | 0 074 880 | 7/1985 |
| EP | 0 952 290 | 10/1999 |
| EP | 1 154 109 | 11/2001 |
| EP | 1 217 159 | 6/2002 |
| GB | 1 543 221 | 4/1976 |

* cited by examiner 1
2
17
10
12
11
9
14
6
19
8
52
53
54
55
5
13
51
A
15
16

1
2
10
17
12
11
14
9
8
6
19
55
52
53
5
13
51
15
16

1
15
17
10
2
12
9
14
11
8
6
19
55
5
13
16

3
4

1
2
5
7
10
11
12
13
15
16
17
32
33
33'
34
34'
35
36

1
2
5
7
10
11
12
13
15
16
17
32
33
33'
34
34'
35
36

ACTUATING MECHANISM FOR A PIVOTABLY MOUNTED ACTUATING ARM

This application is a continuation of International Application of PCT/AT2005/000142, filed Apr. 27, 2005.

BACKGROUND OF THE INVENTION

The present invention relates to an actuating mechanism for a pivotably mounted actuating arm, in particular for driving a flap of a piece of furniture. The actuating mechanism includes a spring device having a spring-loaded setting member and a transmission mechanism which converts the movement of the setting member into a pivoting movement of the actuating arm.

Actuating mechanisms of this type are known in the art in many designs and serve chiefly to move flaps or lifting doors of furniture which are mounted on a horizontal pivoting axis, from the closed position into an open position or in the opposite direction, and to retain the flap in a certain position. For example, DE 26 53 106 A discloses a flap holder of this type, which has two actuating arms acted upon by a spring device. Two cam sections of different design on an actuating arm end run off at a contact face on the second actuating arm. A technical refinement is shown in U.S. Pat. No. 5,904,411, which discloses a flap holder with a pivoting flap, in which a spring-loaded setting part is directly coupled via a rigid connecting arm to a pivoting actuating arm. A translational movement of the setting part is thereby converted into a rotational movement of the actuating arm, which in turn moves the furniture flap into its open or closed position respectively. German published application DE 101 45 856 shows a folding lid for a cupboard, in which a spring-loaded setting part runs off at a setting contour of a cam, which in turn is coupled with an actuating arm to move the furniture flap.

Despite the advantageous technical improvements of the aforementioned publications, one fact, for example, proves to be disadvantageous. Namely, it has emerged that when furniture flaps of different weights are used, the same actuating process takes place. Lighter furniture flaps are moved or damped by the same spring force as heavier furniture flaps, so it is not possible to guarantee a favorable movement or damping process corresponding to the different weight of the furniture flaps.

SUMMARY OF THE INVENTION

It is therefore an object of the present invention to avoid the aforementioned disadvantage of the state of the art.

This is achieved according to the invention in an advantageous embodiment in that the transmission mechanism comprises at least one adjusting device to alter the transmission ratio between the movement of the setting member and the pivoting movement of the actuating arm.

The transmission ratio is preferably defined as the ratio of the path covered by the setting member to the angle of rotation of the actuating arm. DE 101 45 856 for example shows a transmission ratio which varies over the closing or opening path due to the curved design of the setting contour, but this is already pre-determined by the construction of the setting contour. The present invention, contrary to this, has a separately disposed adjustment device, which allows a precise and controlled adjustment of the transmission ratio. The transmission ratio can be varied in such a way that one and the same actuating mechanism can be provided for advantageous movement or damping of furniture flaps of different weights.

One advantageous embodiment of the invention is produced by the fact that the transmission mechanism comprises a pivotably mounted interlever, which is acted, on the one hand, upon by the spring-loaded setting member and on the other hand abuts on a setting contour surface formed on or attached to the actuating arm—preferably via a thrust roller. The lever ratios and thus the transmission ratio of the setting member to the actuating arm can be modified by the pivotably mounted interlever, where for preference a continuous adjustment is provided. It may thereby be advantageous if the position of the point of application of the spring-loaded setting member on the interlever is adjustable, to produce different lever ratios. In this connection it may also be advantageous that the distance of the point of application of the spring-loaded setting member from the axis of rotation of the interlever can be adjusted.

There are various ways to realize the spring device. It may be designed in such a way that the spring device comprises at least two or more—preferably disposed in parallel—tension springs. In a further advantageous embodiment of the invention, provision may also be made that the spring device comprises at least two or more—preferably disposed in parallel—compression springs. Obviously this also includes spring devices which consist of at least one tension spring and at least one compression spring. The spring device may be hingedly supported so that it can pivot in order to equalize tensions. This means that the pre-tensioning force in the direction of the setting member may be advantageously varied or adjusted. A hydropneumatic accumulator can also advantageously be used as a spring device.

According to a further embodiment, provision is made that the adjustment device is disposed or formed on the interlever, by means of which the point of application of the spring-loaded setting member with respect to the interlever can be adjusted. The pre-tension force of the spring device can be varied by the adjustment device such that the respective positions of the individual fulcrums change. Through the resultant lever ratios, the actuating mechanism can be adapted to match various sizes and/or weights of the movable furniture flaps. The design can advantageously be made such that the adjusting device comprises a rod or a threaded spindle along which the point of application of the setting member is displaceable.

A further advantageous embodiment of the invention is produced by the fact that the interlever comprises a crank guide along which the spring-loaded setting member can be guided. For example, a curve shape can be provided in the crank guide—preferably a side facing away from the spring device—through which the pre-tensioning of the spring device or its characteristic curve area can be varied. By the adjustability of the operative range or of the spring force area thus achieved, the transmission ratio can be defined in a controlled way within the specified crank guide.

Provision is advantageously made that the transmission mechanism comprises at least two adjustment devices to change the transmission ratio between the movement of the setting member and the pivoting movement of the actuating arm. It may then be advantageous if two separate adjustment devices are disposed, for coarse and fine adjustment of the transmission ratio respectively.

The inventive arrangement is characterized by a movable furniture part, in particular a furniture flap, with an actuating mechanism according to the invention.

BRIEF DESCRIPTION OF THE DRAWINGS

Further details and advantages of the present invention will be explained in more detail with the aid of the description of the figures while making reference to the drawings, which show.

DETAILED DESCRIPTION OF THE INVENTION

Figure 1A:
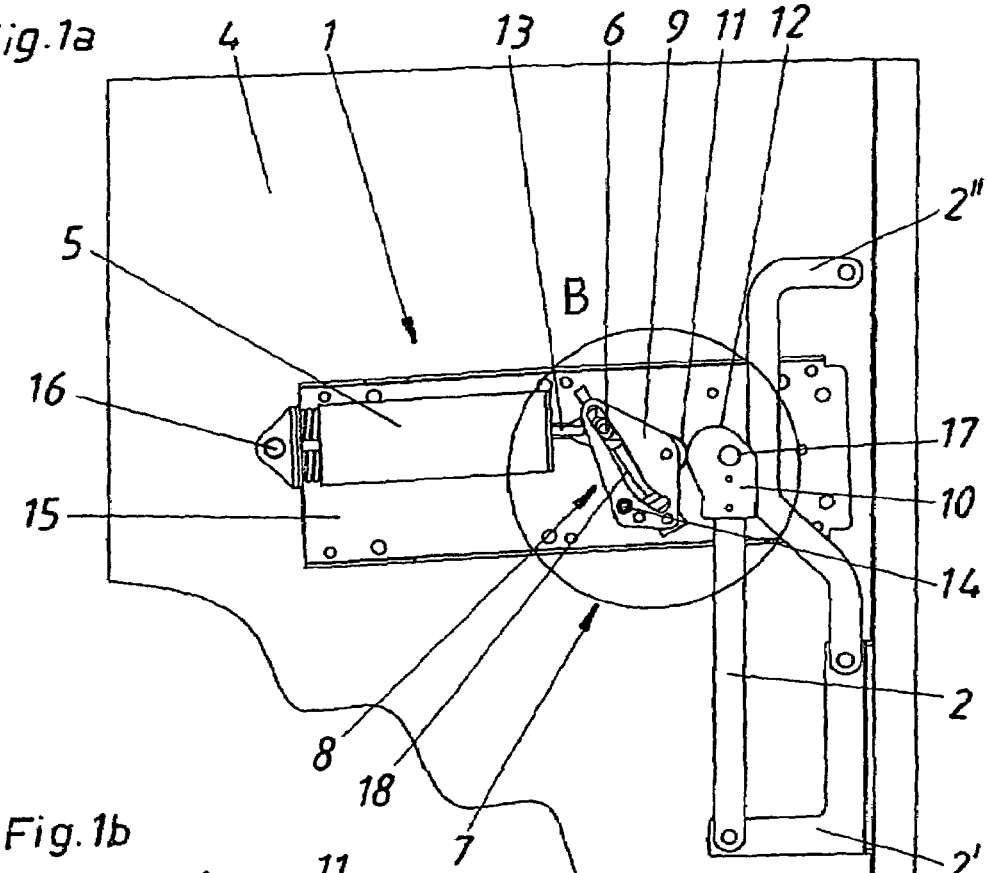
FIG. 1*a*, 1*b* a schematic lateral sectional view through a furniture body with an inventive actuating mechanism in the closed position, with the spring device designed as a compression spring pack, and detail B from FIG. 1*a*, FIG. 2*a*, 2*b* the actuating mechanism from FIG. 1*a*, 1*b* in a half-open position, and detail A from FIG. 2*a*, FIG. 3*a*, 3*b* the actuating mechanism shown in FIG. 1*a*, 1*b* and FIG. 2*a*, 2*b* respectively in the open position, and detail C from FIG. 3*a*, FIG. 4*a*, 4*b*, a further embodiment of a actuating mechanism in the open position in lateral view and in perspective view, where the spring device is designed as a tension spring pack, FIG. 5*a*, 5*b* a lateral view and a perspective view of the actuating mechanism from FIG. 4*a*, 4*b* in a half-opened position, FIG. 6*a*, 6*b* a lateral view and a perspective view of the actuating mechanism from FIG. 4*a*, 4*b* and FIG. 5*a*, 5*b* respectively in the closed position, FIG. 7*a*, 7*b* a lateral view and a perspective view of the actuating mechanism from FIG. 4*a*, 4*b* to FIG. 6*a*, 6*b* with altered transmission ratio, FIGS. 8*a*-8*d*, 8*a*'-8*d*' various potential applications of the inventive actuating mechanism, FIG. 9*a*, 9*b* a schematic exploded view and an assembled view of an inventive actuating mechanism with a compression spring pack as spring device, FIG. 10*a*, 10*b* a schematic exploded view and an assembled view of an inventive actuating mechanism with a tension spring pack as spring device, FIG. 11*a*, 11*b* a lateral view of an exemplary fold-up flap with an inventive actuating mechanism in the closed position and detail C from FIG. 11*a*, FIG. 12*a*, 12*b* the fold-up flap from FIG. 11*a*, 11*b* in the half-open position and detail B from FIG. 12*a*, FIG. 13*a*, 13*b* the fold-up flap from FIG. 11*a*, 11*b* and FIG. 12*a*, 12*b* in the open position and detail A from FIG. 13*a*, FIG. 14*a*, 14*b* a further embodiment of the invention with an adjustable transmission element, FIG. 15*a*, 15*b* the embodiment from FIG. 14*a*, 14*b* with increased transmission ratio, FIG. 16 an exploded view of the embodiment from FIG. 14 and FIG. 15, FIG. 17*a*-17*c* perspective views of a further embodiment with two adjustment devices to modify the transmission ratio, FIG. 18*a*, 18*b* lateral views of the embodiment from FIGS. 17*a* to 17*c* in detail, and with cover removed, FIG. 19*a*, 19*b* views during the coarse adjustment of the transmission ratio, FIG. 20*a*-20*c* views during the fine adjustment of the transmission ratio, FIG. 21*a*, 21*b* an exploded view of the transmission mechanism and an enlarged detail view, FIG. 22 a further embodiment of the invention with two levers hingedly connected to each other, FIG. 23 a perspective view of the embodiment from FIG. 22, FIG. 24*a*, 24*b* lateral views of the embodiment from FIG. 22 and FIG. 23 with the pivoting arm in the fully open position and in a half-open position.
Figure 1B:
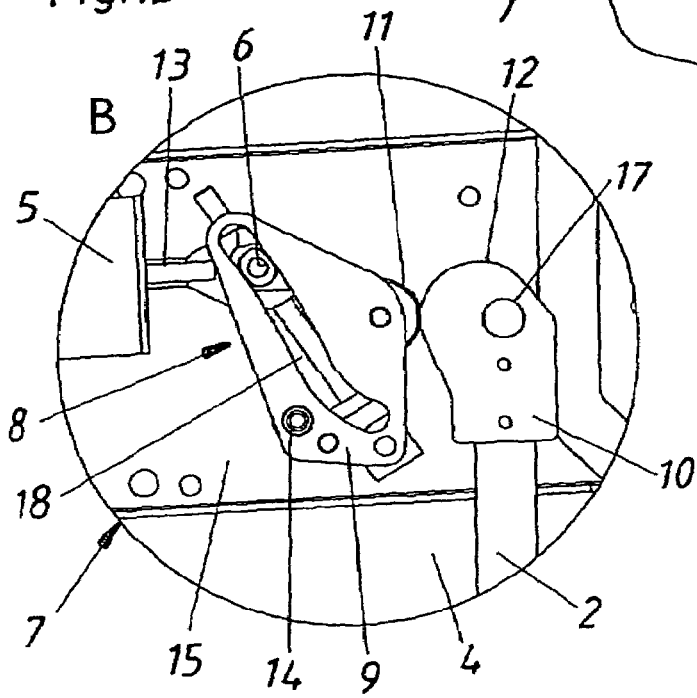

FIG. 1*a* shows a schematic view of an embodiment of an inventive actuating mechanism 1 in the closed position with a flap 3 pivotable about a horizontal axis, FIG. 1*b* shows an enlarged view of detail B from FIG. 1*a*. This actuating mechanism 1 is fixed by means of a suspension device 15 on one vertical inner wall of a body of furniture 4. The actuating mechanism 1 has a pivotably mounted actuating arm 2, which is provided with the flexibly connected levers 2', 2" to move the flap 3 between an open and a closed position. The spring device 5 in the embodiment shown is designed as a compression spring pack, which has at least one or more compression springs—preferably arranged in parallel. The spring device 5 acts on a movably mounted setting member 13 with a force which acts in the direction of (toward) the flap 3. The setting member 13 is thus linearly displaced in proportion to the loading of the spring device 5. A transmission mechanism 7 converts the linear motion of the setting member 13 into a pivoting motion, which in turn acts on the actuating arm 2 to move the flap 3. The transmission mechanism 7 comprises an adjustment device 8 to alter the transmission ratio between the linear motion of the setting member 13 and the pivoting motion of the actuating arm 2. In the figure shown the transmission mechanism 7 comprises an interlever 9 so as to pivot mounted about the axis of rotation 14, the interlever 9 being acted on from one side by the spring-loaded setting member 13 and on the other side abutting on a setting contour surface 12 formed on or attached to the actuating arm 2 via a thrust roller 11. The setting contour surface 12 is formed or arranged on the end of the actuating arm 2 in the form of a curved control cam 10. The control cam 10 is mounted on the axis of rotation 17, and when the flap 3 is moved, it meshes with the thrust roller 11. The interlever 9 is thereby pivoted by the spring-loaded setting member 13 clockwise about the axis of rotation 14, as made clear in the following figures.

Figure 2A:
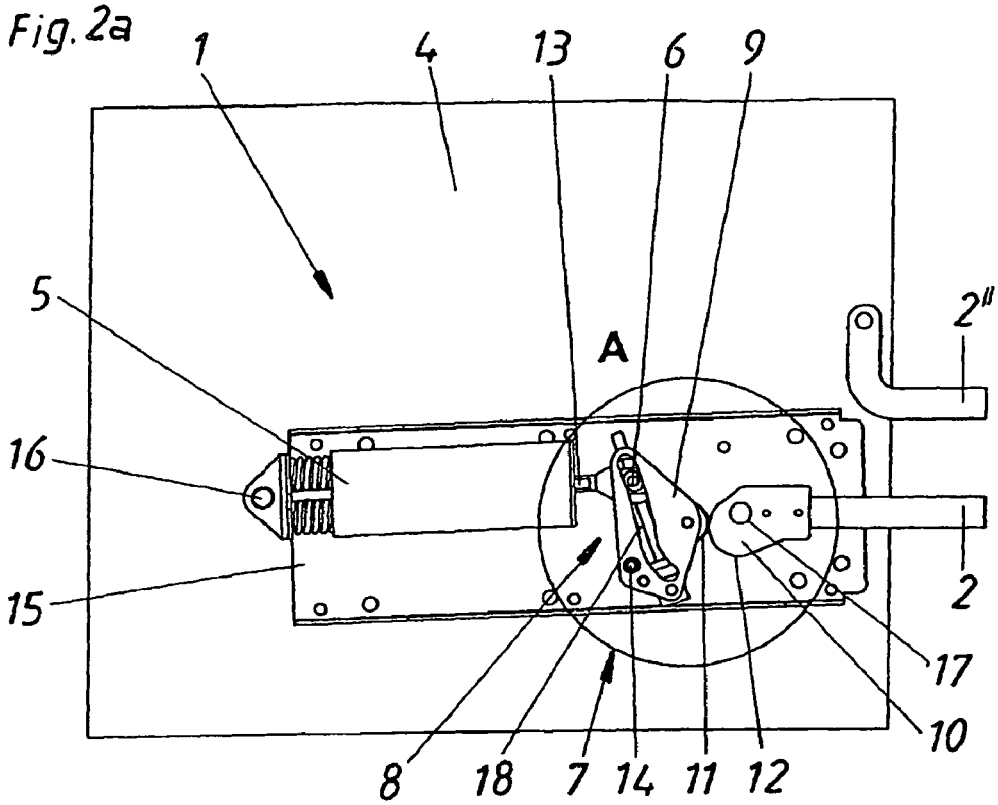
Figure 2B:
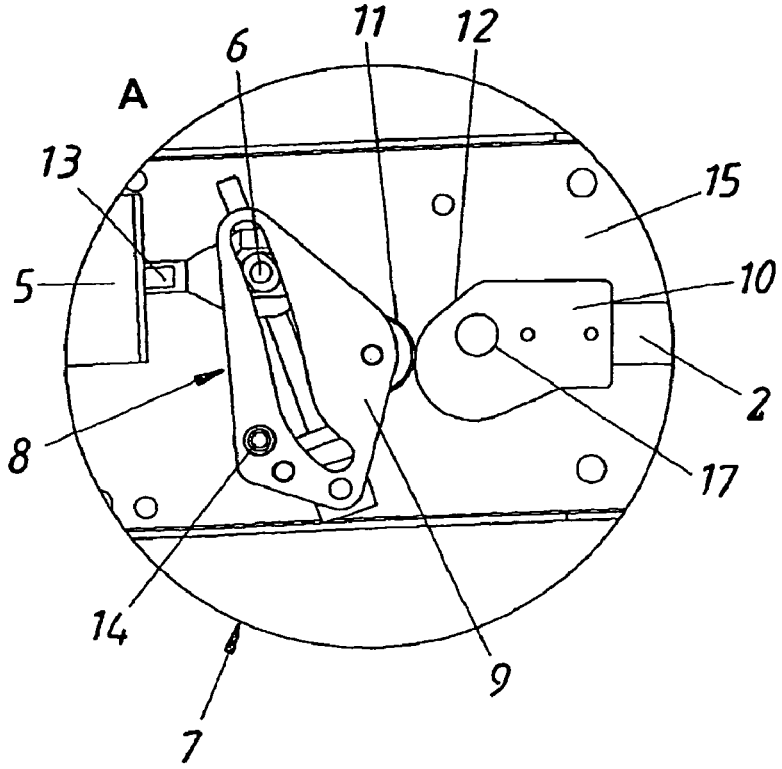

FIG. 2*a* shows the actuating mechanism 1 from FIG. 1*a*, 1*b* in a half-open position. FIG. 2*b* shows an enlarged view of detail A from FIG. 2*a*. The actuating mechanism 1 comprises a spring device 5 which is designed as a compression spring pack. The spring device 5 in the view shown is already partly unloaded in comparison to the spring device 5 from FIG. 1. The control cam 10 mounted on the fulcrum (axis of rotation) 17 rolls along the thrust roller 11, as a result of which the interlever 9 mounted at the axis of rotation 14 is rotated clockwise by the spring-loaded setting member 13. The application force of the thrust roller 11 is determined by the tension force of the spring device 5 and by the respective position of the control cam 10 with the setting contour surface 12 relative to the thrust roller 11.

Figure 3A:
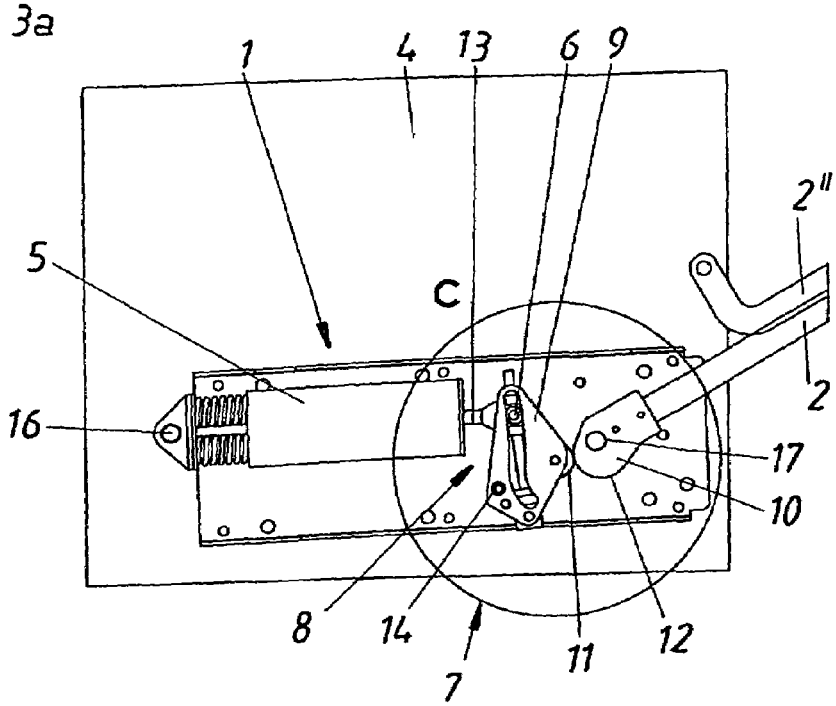
Figure 3B:
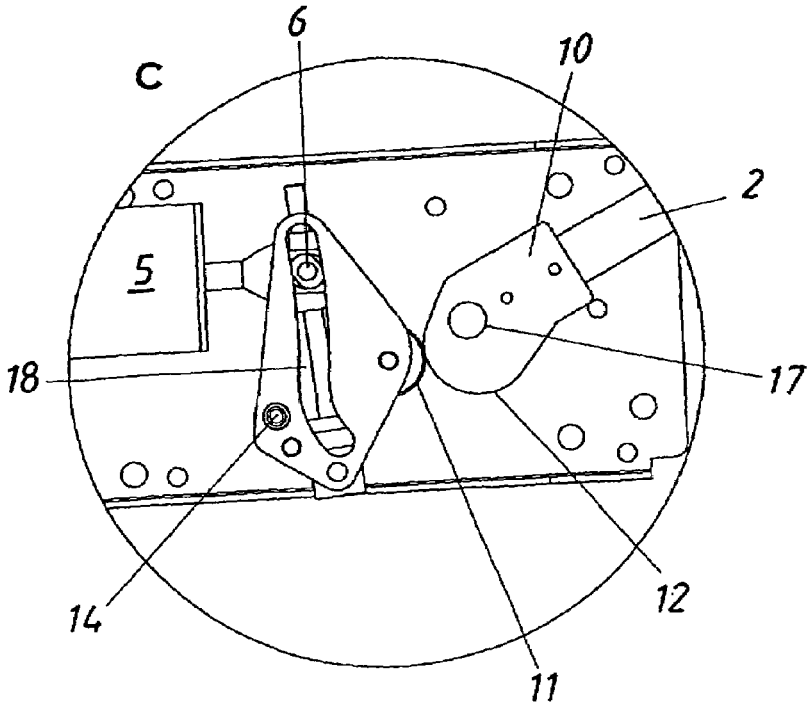

FIG. 3*a* shows the actuating mechanism 1 from FIG. 1*a*, 1*b* and FIG. 2*a*, 2*b* respectively in the open position. FIG. 3*b* shows an enlarged view of detail C from FIG. 3*a*. The compression springs of the spring device 5 are essentially in a relaxed condition, whereby however a certain force acts at all times on the interlever 9, so that the furniture flap 3 can be held in any position over at least a part of the pivoting path. In FIGS. 1 to 3, for reasons of clarity, the transmission ratio has not been changed by the adjustment device 8, since the point of application 6 has not been displaced within the crank guide 18.

Figures 4A, 4B:
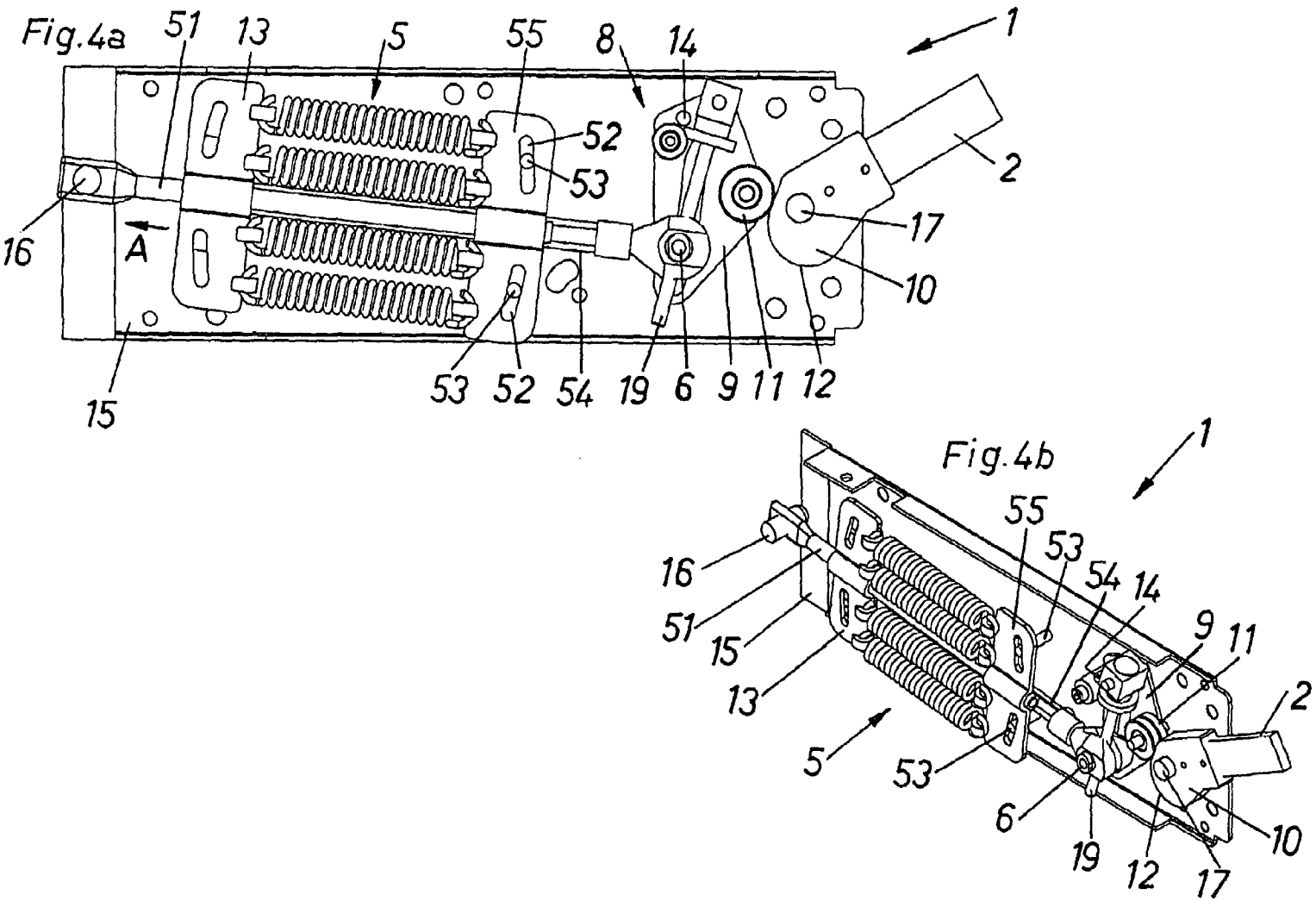

FIGS. 4*a* and 4*b* show a further embodiment of the invention in a lateral and in a perspective view. The spring device 5, unlike those in FIGS. 1 to 3, is designed as a tension spring pack. The spring-loaded setting member 13 in the figure shown is displaceably mounted along the guide rod 51. The spring-loaded setting member 13 acts upon a trough-shaped push rod 54, which is coupled at its other end with the interlever 9. The relevant point here is that the push rod 54 is not connected with the spring suspension 55, i.e. the trough-shaped push rod 54 is displaceably guided behind the spring suspension 55. The interlever 9 is pivotably mounted on its axis of rotation 14, whereby the spring device 5, via the push rod 54, exerts a counter-clockwise force on the interlever 9. The actuating arm 2 (and thus a flap 3, not shown) in the figure shown is in the open position. The actuating arm 2 is pivotably mounted on the fulcrum 17 and has a control cam 10 with a setting contour surface 12. The thrust roller 11 is pressed by the force of the spring device 5 onto the setting contour surface 12. When the actuating arm 2 is now moved downwards, the setting contour surface 12 rolls down along the thrust roller 11, so that the interlever 9 is pivoted clockwise about the axis of rotation 14. This also displaces the push rod 54 to the left and pushes the spring-loaded setting member 13, in the direction of the arrow A shown, gradually to the left, as the result of which the spring device 5 is tensioned. The spring suspension 55 is mounted in an essentially fixed position by the two pins 53, allowing only slight play compensation by the two longitudinal hole type guides 52. In principle, the spring suspension 55 could also be disposed completely fixed. But since the guide rod 51 is movably mounted on the pivoting axis 16 opposite the suspension device 18, a compensating movement of the spring suspension 55 can be enabled by the longitudinal hole type guides 52. The adjustment device 8 for adjusting the transmission ratio comprises a rod 19 or a threaded spindle mounted on the interlever 9 along which the point of application 6 of the push rod 54 is displaceably mounted.

Figure 5A:
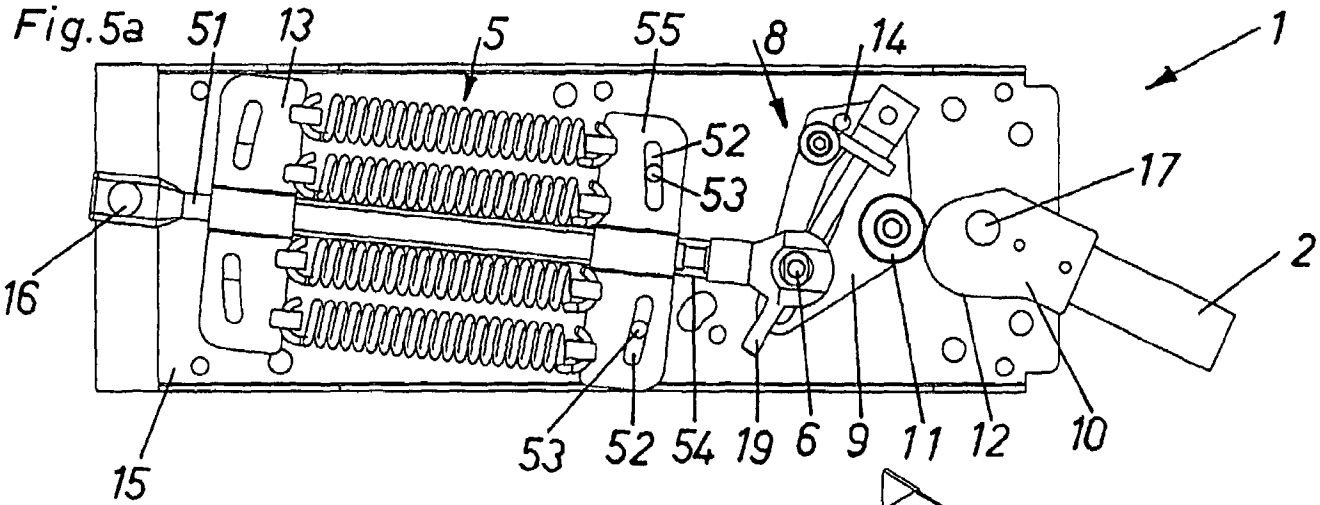
Figure 5B:
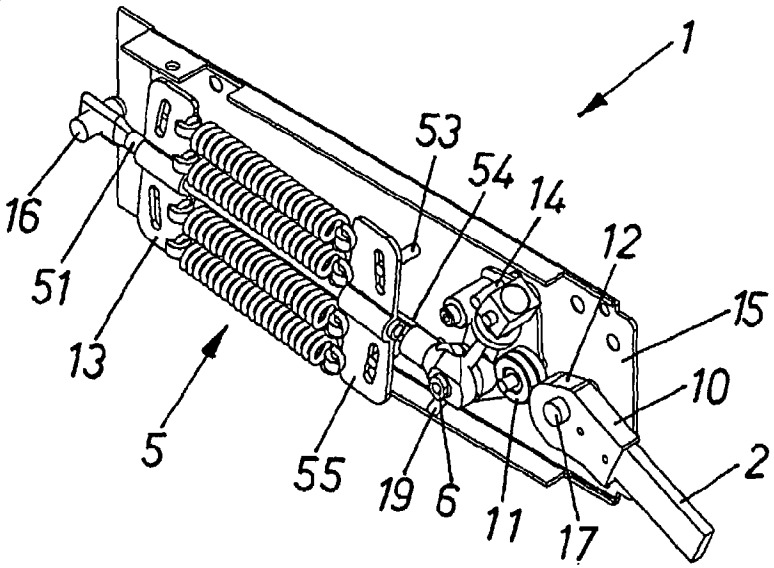

FIG. 5*a* and FIG. 5*b* show the actuating mechanism 1 from FIG. 4*a*, 4*b* in a half-open position of the actuating arm 2. It can be seen that the interlever 9 mounted on the axis of rotation 14 has been pivoted clockwise by the closing movement of the actuating arm 2. This movement has also caused the trough-shaped push rod 54 to be moved further to the left against the spring-loaded setting member 13 linked thereto. The springs of the spring device 5 are gradually tensioned in this process and the resultant force presses the thrust roller 11 against the setting contour surface 12 of the actuating arm 2. This force can be measured by the adjustability of the transmission ratio to compensate for the weight of the flap 3, so that the flap 3 is preferably held in every pivoted position of the actuating arm 2.

Figures 6A, 6B:
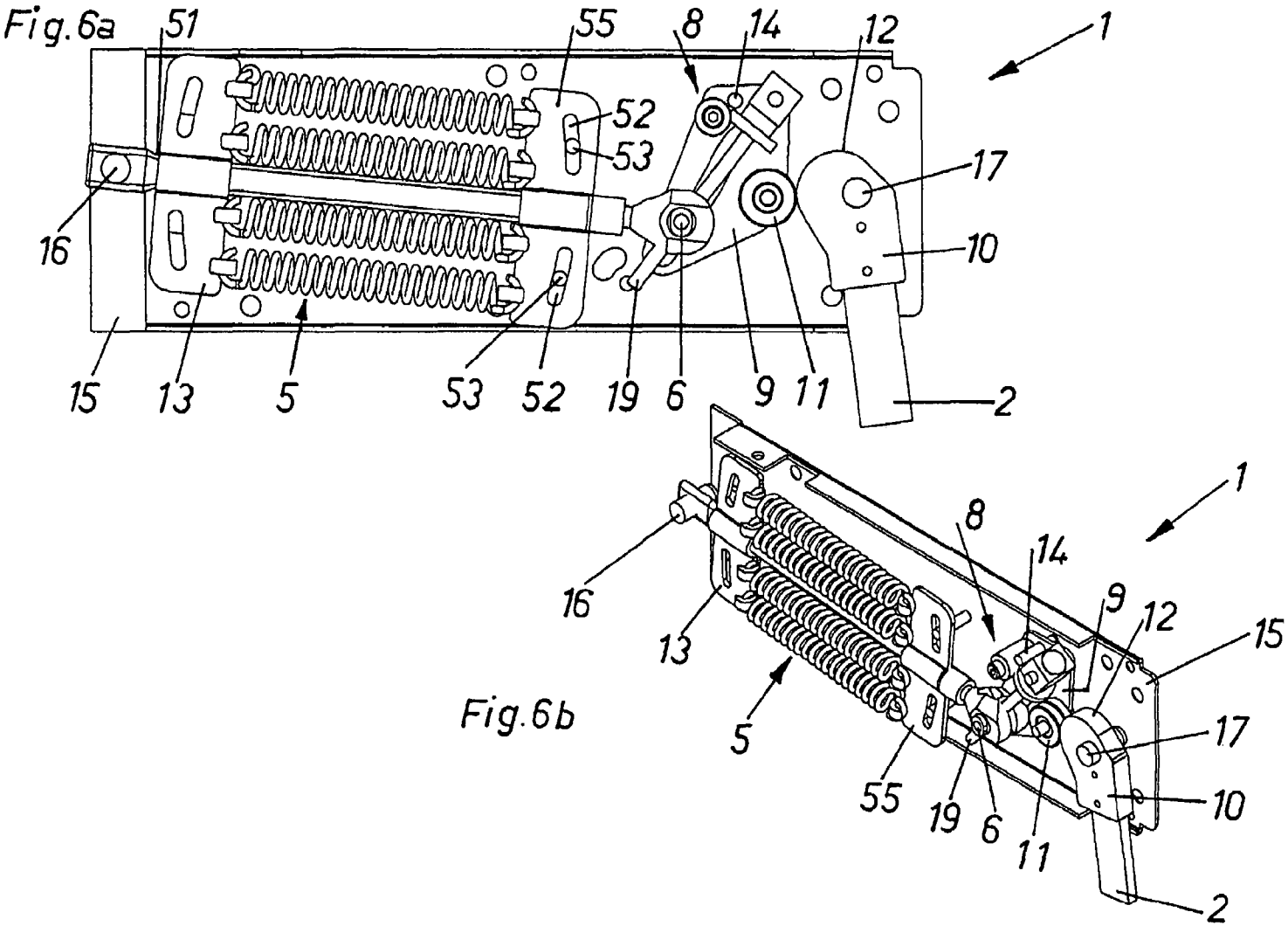

FIG. 6*a* and FIG. 6*b* show the actuating mechanism 1 from FIG. 4*a*, 4*b* and FIG. 5*a*, 5*b* in the fully closed position of the actuating arm 2 (and with it a flap 3, not shown). The interlever 9 mounted on the axis of rotation 14 has been pivoted still further clockwise by the closing movement of the actuating arm 2. This has pushed the trough-shaped push rod 54, no longer visible, behind the fix-mounted spring suspension 55, so that the spring-loaded setting member 13 is in the outermost end position relative to the guide rod 51, so that the springs of the spring device 5 are also in a condition of maximum tension. In FIGS. 4 to 6 the transmission ratio has not been changed for reasons of clarity, since the point of application 6 has not been moved in its position relative to the rod 19.

Figures 7A, 7B:
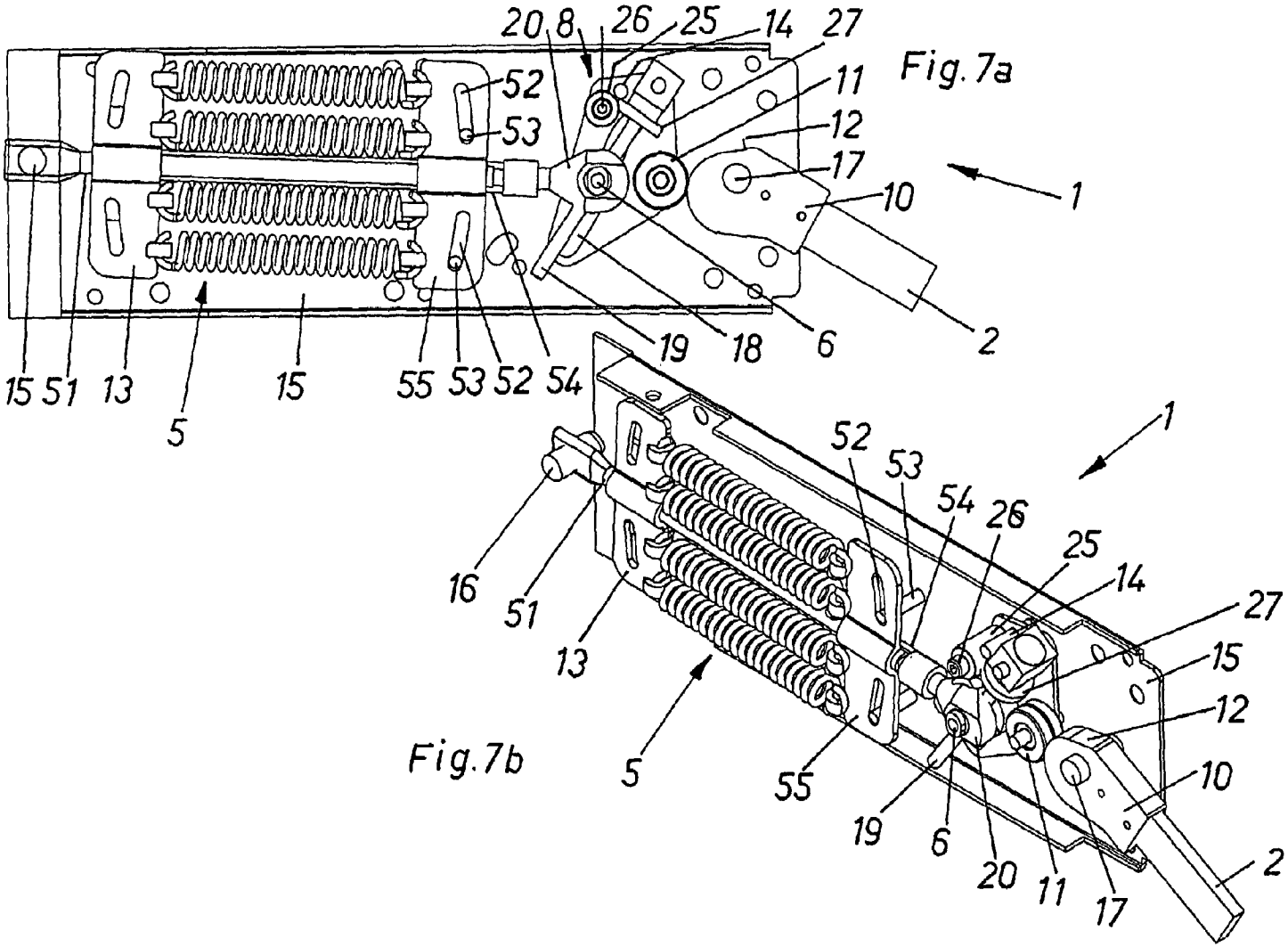

FIG. 7*a* and FIG. 7*b* show the actuating mechanism 1 from FIG. 4*a*, 4*b* to FIG. 6*a*, 6*b* with a tension spring pack as spring device 5. In the figure shown, the transmission ratio has been altered by a displacement of the point of application 6 on the interlever 9, which is achieved by the adjustment device 8 on the interlever 9. The point of application 6 is displaceably mounted on a rod 19, whereby the rod 19 is preferably designed as a threaded spindle. A geared wheel 25—preferably a toothed wheel—which can be adjusted with a hexagonal member 26, is provided to adjust the point of application 6. The gear wheel 25 meshes with an intermediate wheel 27, which is integrally fixed to the threaded spindle 19. The point of application 6 is displaced via a bolt 28, not shown, inside the coupling piece 20, the bolt 28 being provided with an internal thread. Any rotation of the hexagonal member 26 thus effects a rotation of the gear wheel 25, which moves the intermediate wheel 27 integrally mounted on the threaded spindle 19, whereby the rotation of the threaded spindle brings about a height (location) adjustment of a bolt 28 (i.e., location of bolt 28 along spindle 19) provided with an inner thread. A self-locking worm gear with play-free, or at least with minimal play, can hereby be enabled to displace the point of application 6. The adjustment of the hexagonal member 26 can obviously also be done without tools, for example with a knurled screw turned by hand. The point of application 6 can thereby also be displaceably guided within a crank guide 18. The crank guide 18 can also have a curved shape or a curvature, as the result of which the tensioning of the spring device 5 and with it the characteristic curve area thereof, can be altered. Different lever ratios are created by the altered position of the point of application 6, since the relative positions of the individual points of rotation are also altered. In the figure shown, the pressure of the thrust roller 11 on the setting contour surface 12 is reduced due to the displaced position of the point of application 6, so that lighter furniture flaps 3 can be advantageously moved and damped according to their weights.

FIGS. 8*a*-8*d* and FIGS. 8*a*'-8*d*' show various potential applications of the inventive actuating mechanisms 1. The views each show a lateral view of the furniture bodies 4 on which a furniture flap 3 opening upwards is disposed. The upper rows according to FIGS. 8*a*-8*d* each show the closed position of the furniture flap 3, while the lower views in FIGS. 8*a*'-8*d*' show a lift-up flap, in FIG. 8*b*' a bifold upward flap, in FIG. 8*c*' a high-lift flap and in FIG. 8*d*' a swing-up flap in an open position.

Figures 9A, 9B:
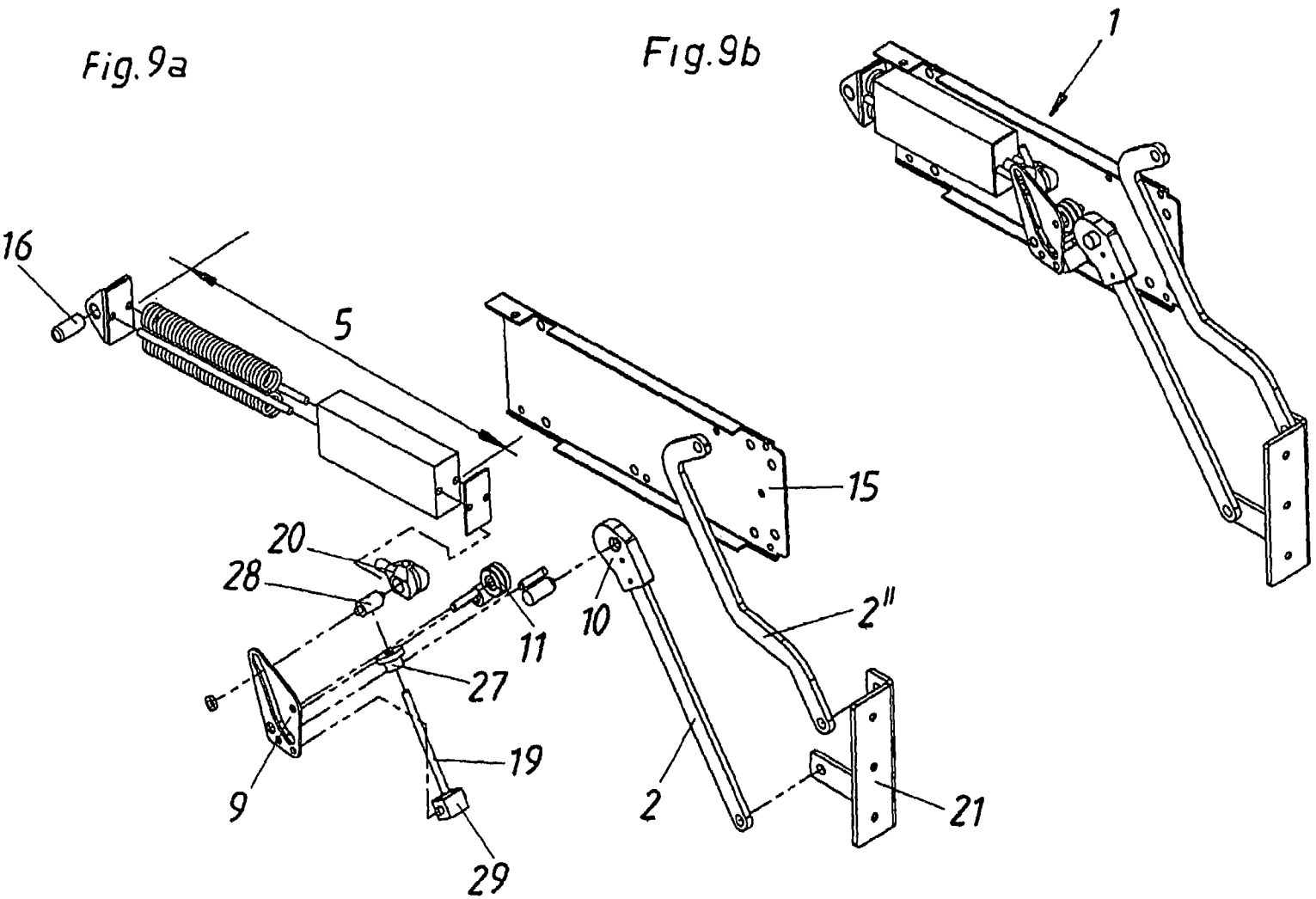
Figures 10A, 10B:
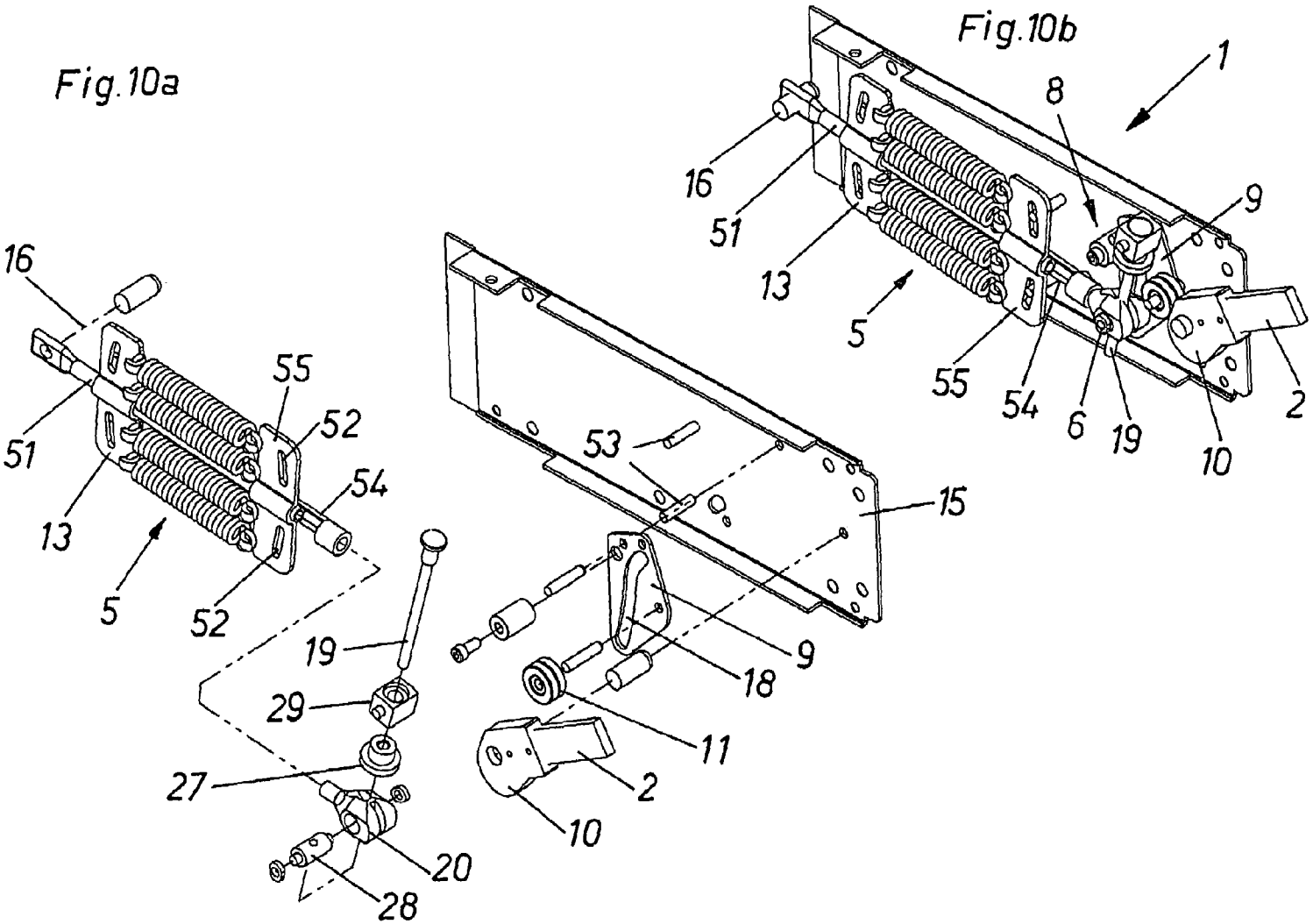

FIG. 9*a* and FIG. 10*a* show exploded views of the actuating mechanism 1 from FIGS. 1 to 3 (compression spring pack) and the actuating mechanism 1 from FIGS. 4 to 6 (tension spring pack), FIG. 9*b* and FIG. 10*b* show the respective actuating mechanism 1 in mounted condition. The actuating mechanisms 1 are mounted on the furniture body 4 by means of a suspension device 15. The threaded spindle 19 is passed through a rod end bearing and integrally connected to an intermediate wheel 27. Also to be seen is the bolt 28, which has an inner thread and sits within the coupling piece 20. The threaded spindle 19 engages in the thread of the bolt 28, so as to displace the setting member 13 in the axial direction of the threaded spindle 19. A fitting 21 is provided to link both levers 2, 2' with the flap 3.

Figure 11A:
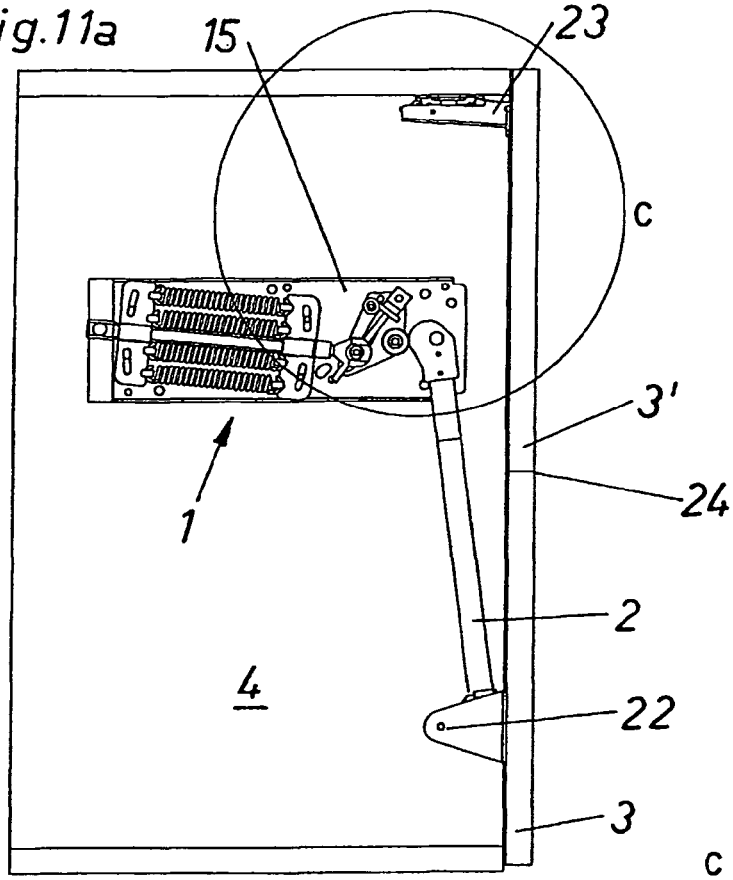
Figure 11B:
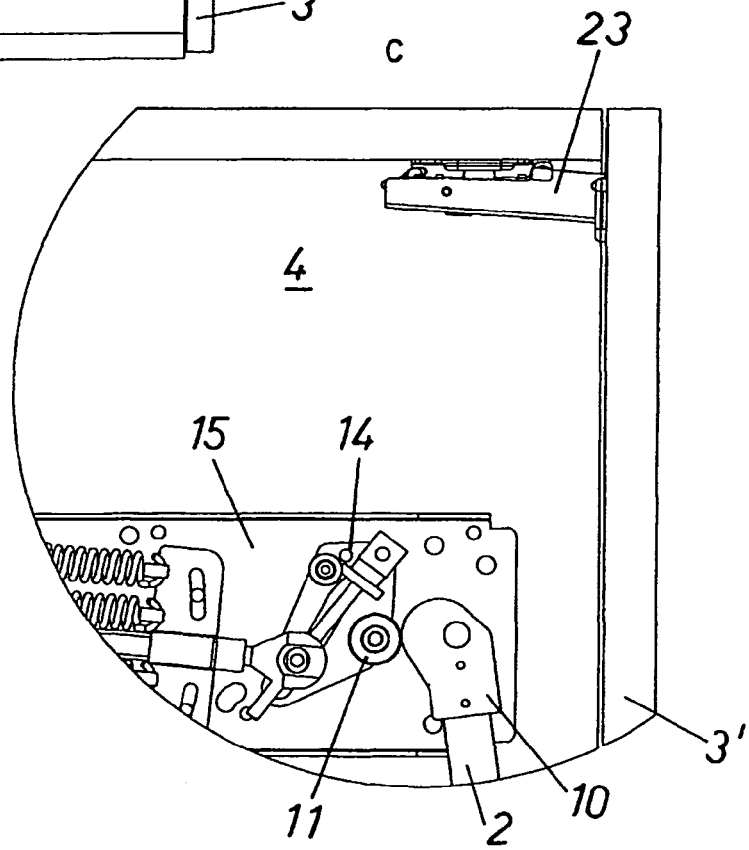
Figure 12A:
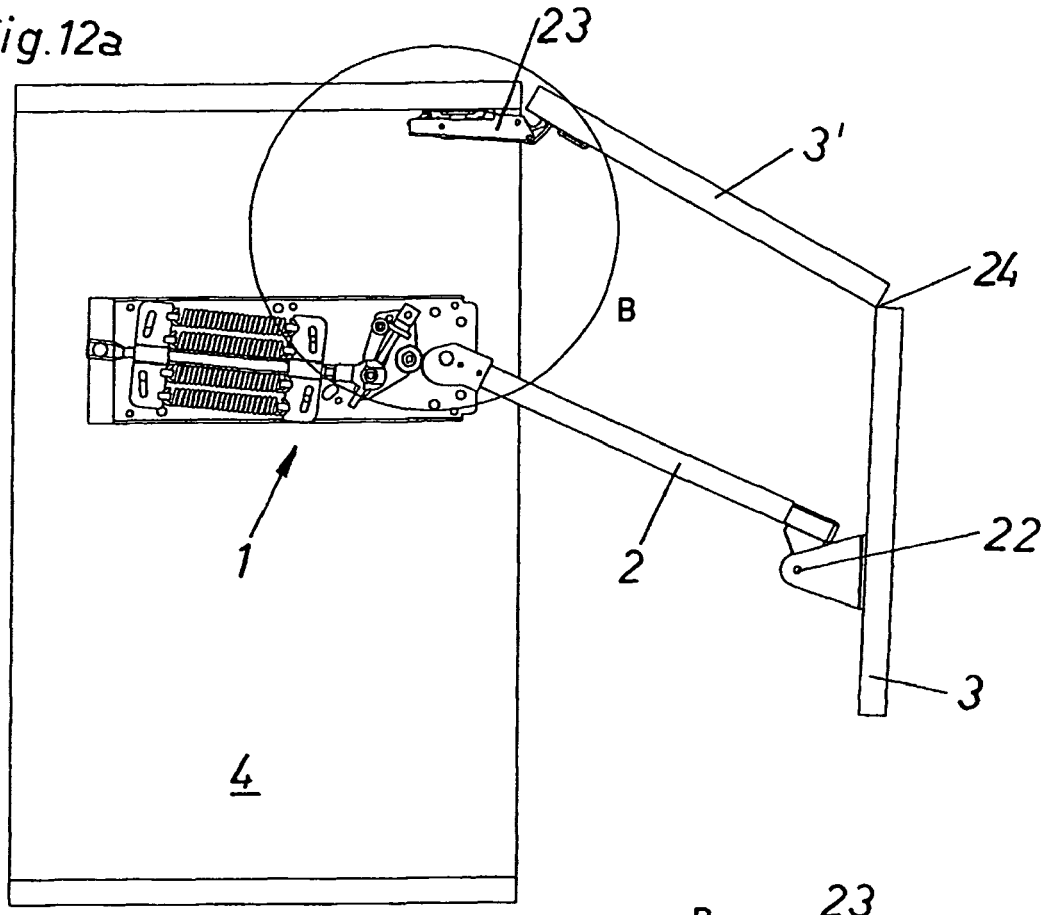
Figure 12B:
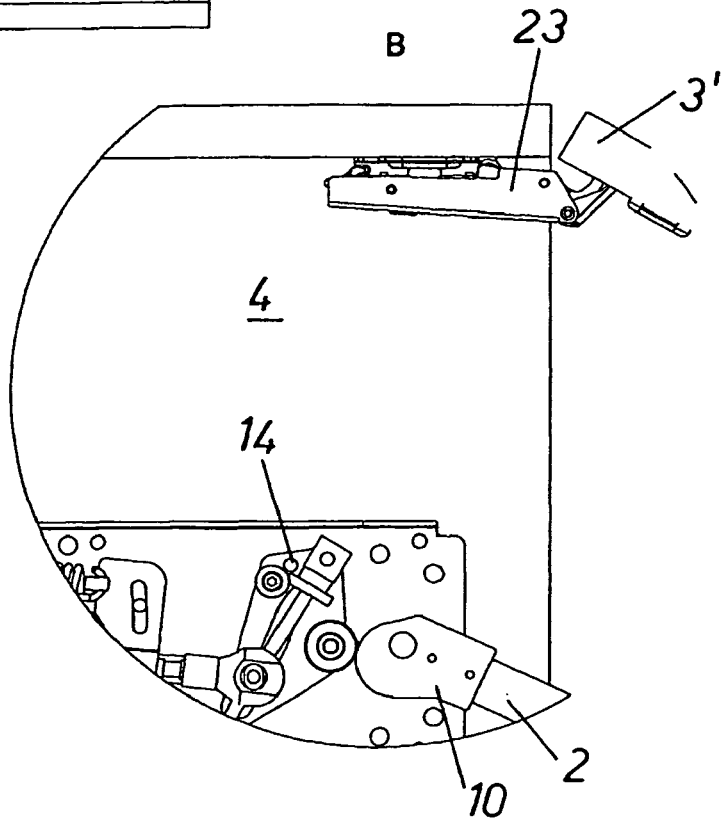
Figure 13A:
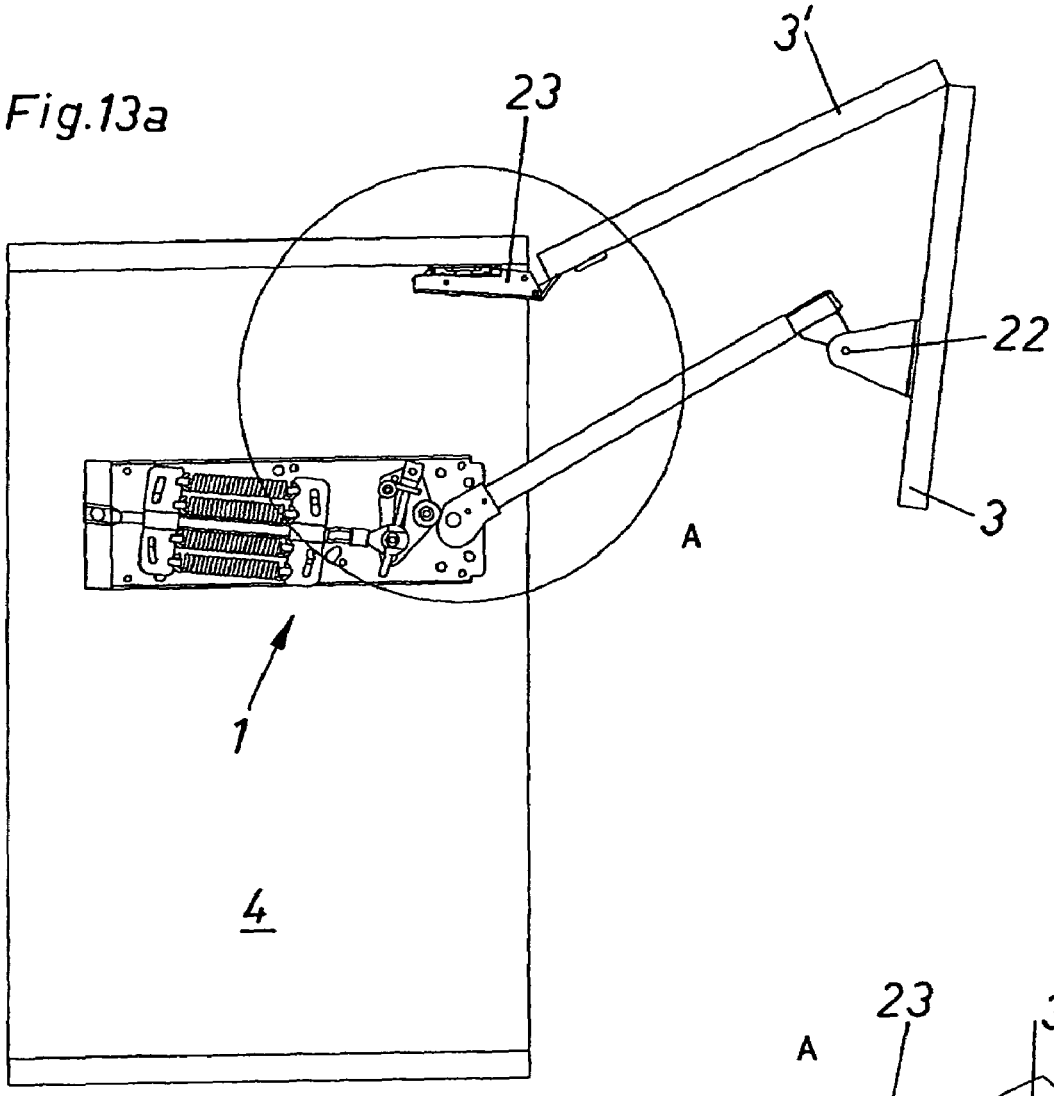
Figure 13B:
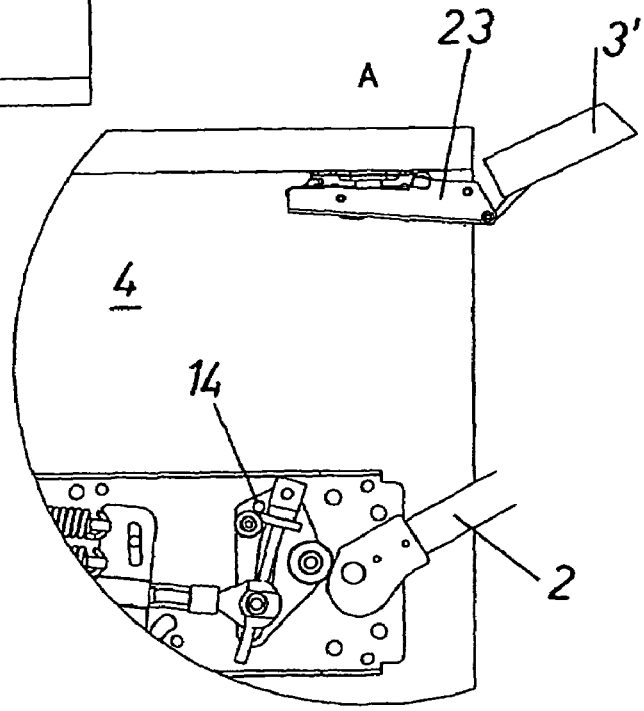

FIG. 11*a* shows a lateral view of an exemplary bifold flap 3 arranged so as to open upwardly with an inventive actuating mechanism 1 in the closed position. FIG. 11*b* shows the enlarged detail C from FIG. 11*a*. The actuating mechanism 1 is fixed via a suspension device 15 to one vertical side wall of the furniture body 4. A furniture flap 3 is disposed on its pivotably mounted actuating arm 2 at a hinge point 22. The furniture flap 3 is flexibly attached via a horizontal pivoting axis 24 to the flap part 3'. To pivot the flap part 3' in relation to the furniture body 4, a hinge 23 with at least two hinge arms is provided, which allows a pivoting motion about a horizontal axis. FIGS. 12*a*, 12*b* show the actuating mechanism 1 in the open position. In this case the design can be such that the actuating arm 2 is acted upon over at least a part of the pivoting path by a torque which allows the flap 3, 3' to dwell in any position between an open and a closed position.

Figures 14A, 14B:
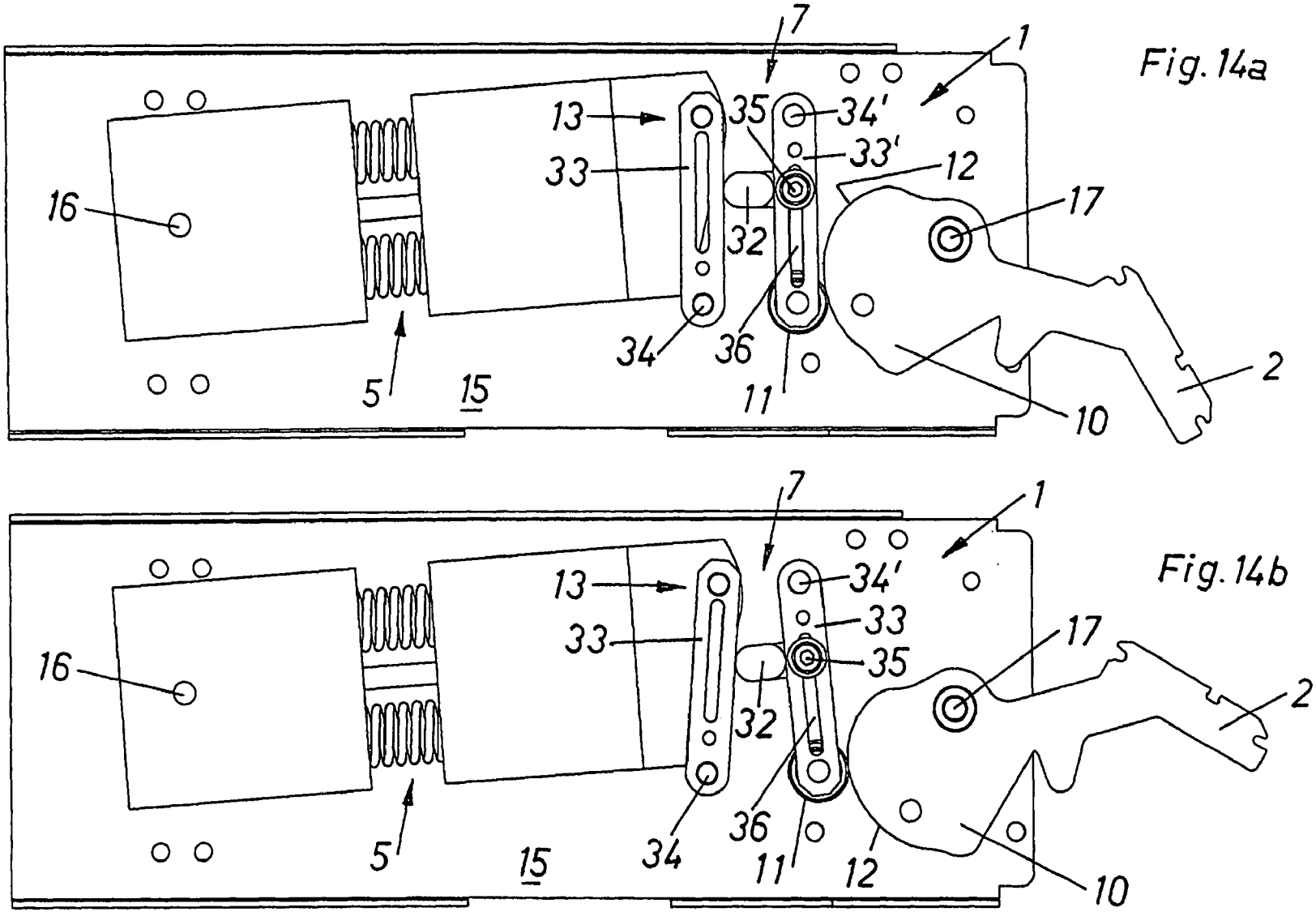

FIGS. 14*a* and 14*b* show the lateral view of the actuating mechanism 1 according to a further embodiment of the invention. The actuating arm 2 in FIG. 14*a* is in a slightly open position, and in FIG. 14*b* in a further opened position. The actuating mechanism 1 is fixed by means of a suspension device 15 to a vertical side wall of a furniture body. The spring device 5 is pivotably mounted on a fixed swiveling axis 16. This spring device 5 comprises a compression spring pack, which acts on the setting member 13 with a force in the direction of (toward) the setting contour surface 12 of the control cam 10. The setting member 13, contrary to the linear movement shown in FIG. 1 to 13, performs a pivoting movement. The transmission mechanism 7 in the figure shown has two levers 33, 33' which are rotatably and fixed-mounted respectively on a fulcrum 34, 34'. A transmission element 32 which can be adjusted by a user is disposed between the two levers 33, 33', with the position of the transmission element 32 determining the transmission ratio of the path of the setting member to the angle of rotation of the actuating arm 2. If the transmission element 32 is being adjusted further downwards between these two levers 33, 33', the setting member 13 can move further to the right. This increases the expansion path and with it the range of action of the spring pack 5. The lever 33' has a thrust roller 11 on its end facing away from the fulcrum 34', the roller 11 being pressed against the setting contour surface 12 of the control cam 10. The control cam 10 is rotatably fixed on its fulcrum 17. The control cam 10 is disposed or formed on the end of the actuating arm 2, by which a flap 3 is movable into the open or closed position.

Figures 15A, 15B:
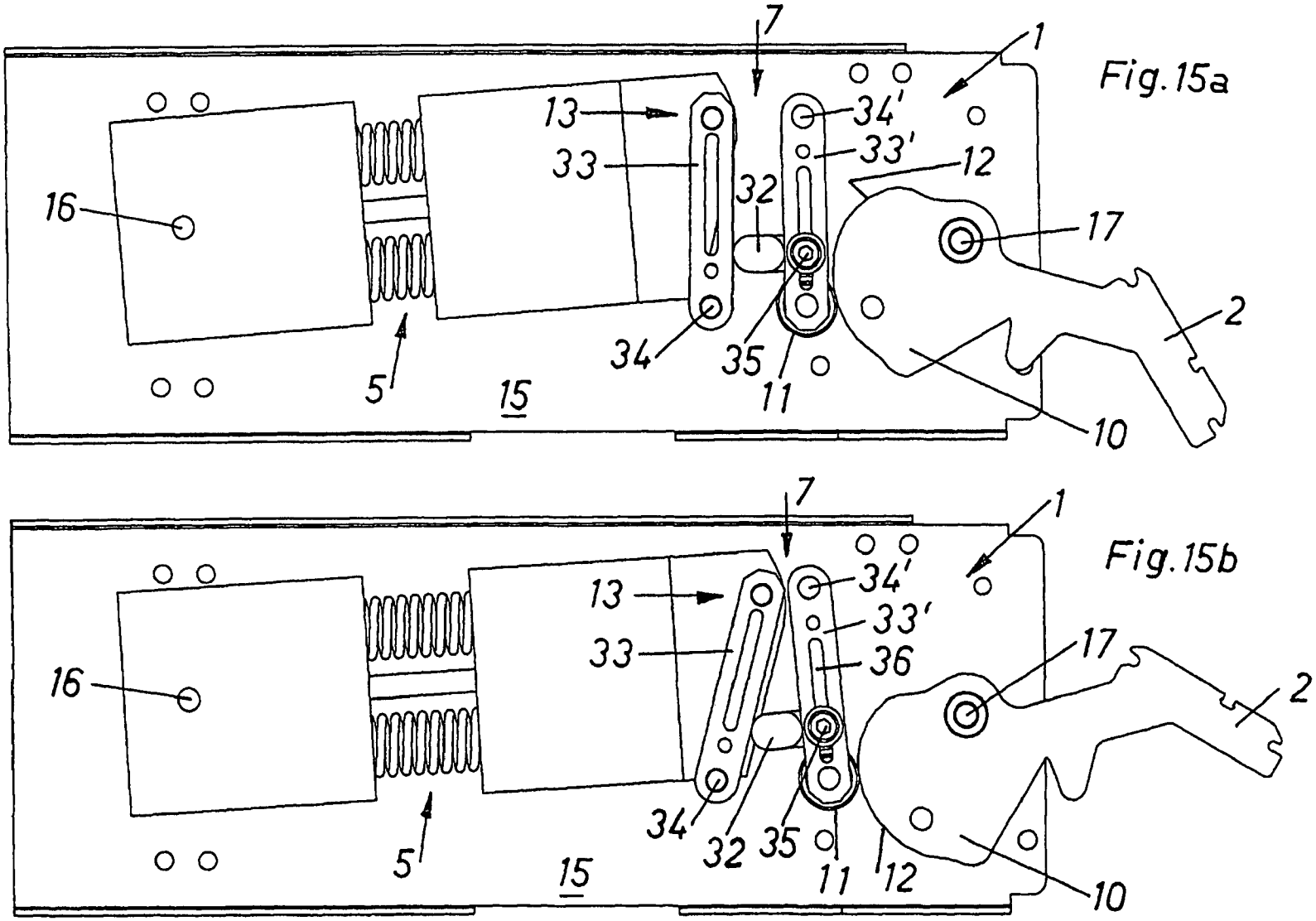

FIGS. 15*a* and 15*b* show the embodiment from FIG. 14*a* and FIG. 14*b* respectively with transmission element 32 moved further downwards. By adjusting the transmission element 32 in the direction of the fulcrum 34 of the lever 33, the setting member 13 can be displaced further to the right, which results in a greater expansion path for the spring device 5 and an increase in the transmission ratio. The transmission ratio can thus be adjusted in simple fashion, depending on the position of the transmission element 32. In the embodiment shown, the lever 33' has at least one longitudinal hole 36, along which the transmission element 32 can be guided. This is fixed with the aid of the locking screw 35. However, the transmission element 32 can be attached just as well on the lever 33 connected with the setting member 13.

Figure 16:
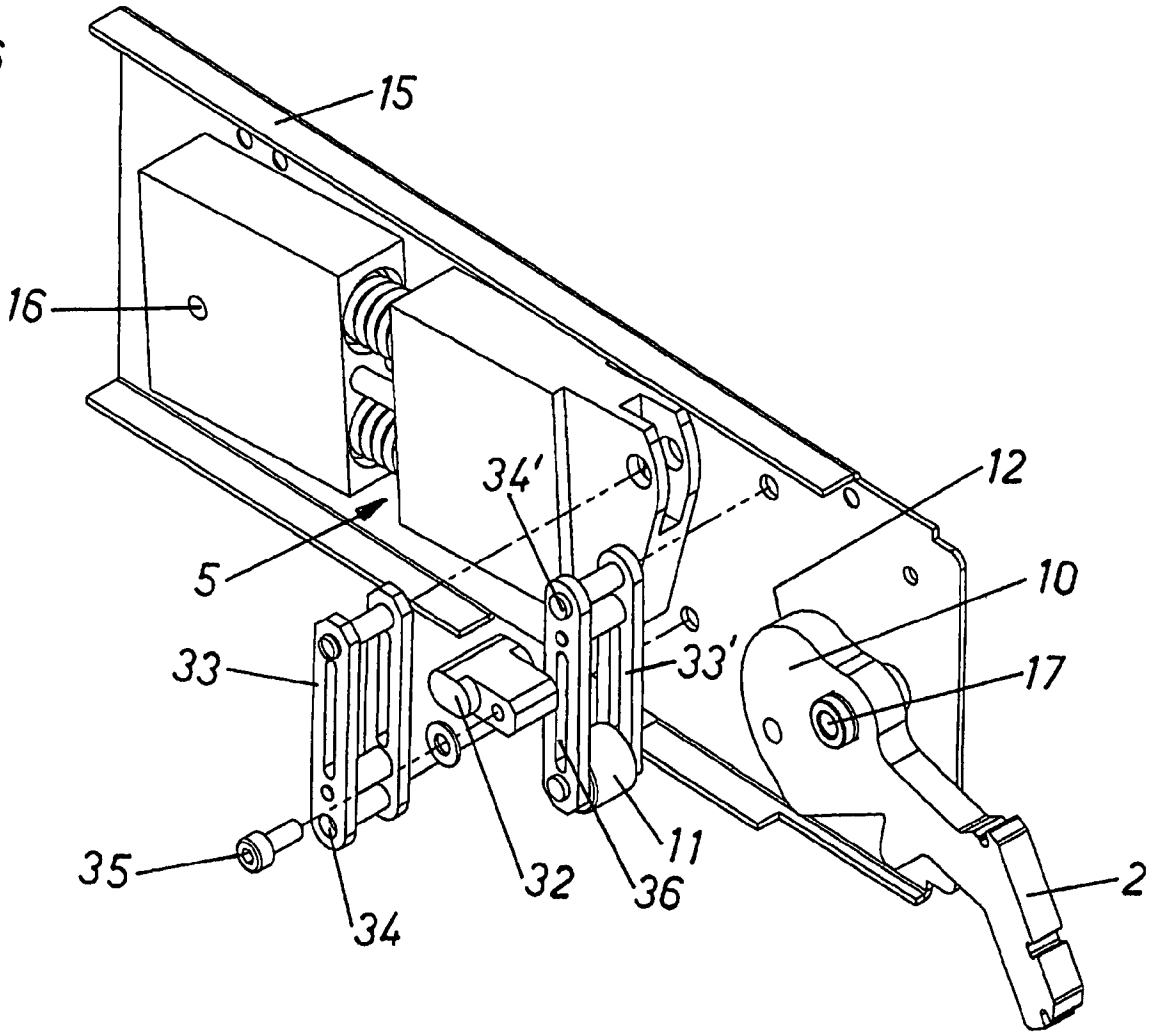

FIG. 16 shows an exploded view of the inventive embodiment from FIGS. 14*a, b* and FIGS. 15*a, b*. The two levers 33, 33' can be seen, their stationary fulcrums 34, 34' being offset with respect to the suspension device 15. The lever 33' has a longitudinal hole 36, while a locking screw 35 passes through the lever 33' and the transmission element 32 and fixes these in place. The length of the longitudinal hole 36 determines the upper and lower end range of the transmission ratio.

Figure 17A:
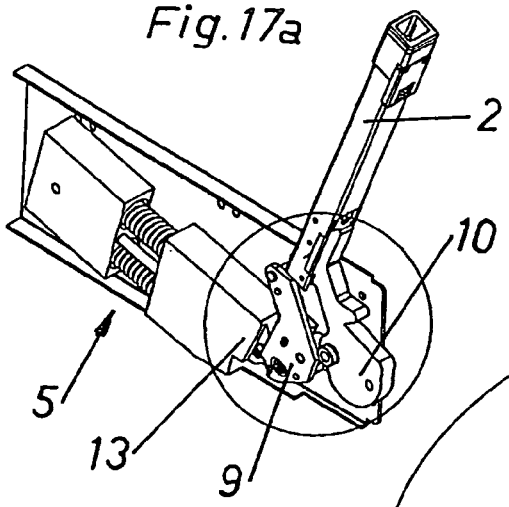
Figure 17C:
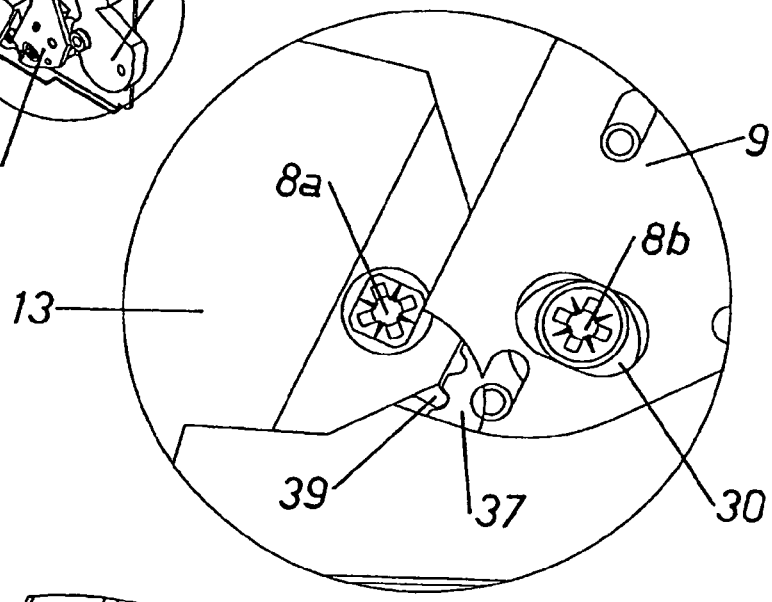
Figure 17B:
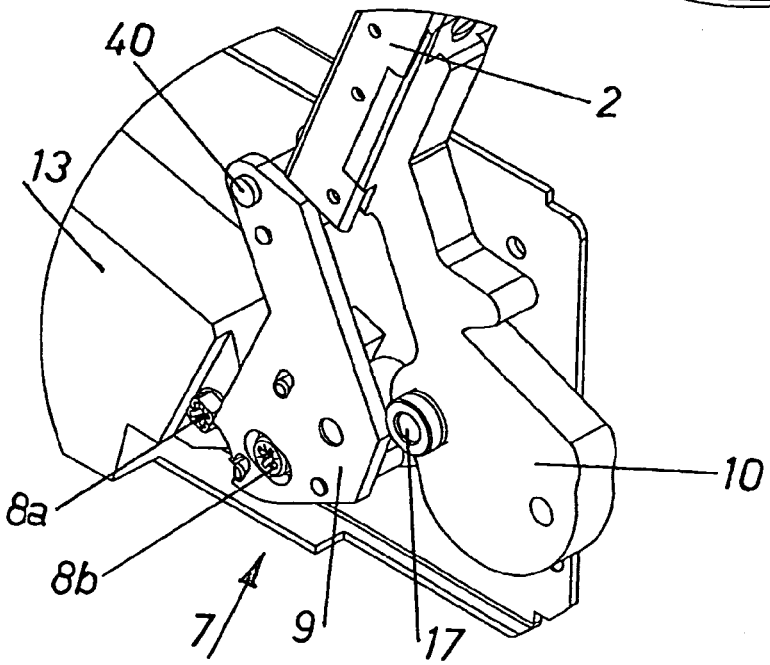

FIG. 17*a* shows a further embodiment of the invention. FIGS. 17*b* and 17*c* each show enlarged detail views. The setting member 13 on which the force of the spring device 5 acts is coupled with the actuating arm 2 via an interlever 9 and via the control cam 10. In this embodiment, provision is made that the transmission mechanism 7 comprises at least two adjustment devices 8*a* and 8*b* to vary the transmission ratio between the movement of the setting member 13 and the pivoting movement of the actuating arm 2, as shown in FIGS. 17*b* and 17*c* respectively. The position of the bearing point of the setting member 13 on the interlever 9 can be adjusted by the adjustment device 8*a* and 8*b*, so that the transmission ratio can be exactly defined. The interlever 9 is fixed and pivotably mounted on the fulcrum 40. Advantageously, provision is made that the transmission ratio is differentially adjustable by the at least two adjustment devices 8*a* and 8*b*. The design can thereby be made such that adjustment device 8*a* is provided for coarse adjustment and adjustment device 8*b* for fine adjustment of the transmission ratio. The position of the point of application of the setting member 13 on the interlever 9 can be exactly set by the adjustment devices 8*a* and 8*b*, and thus also the transmission ratio. FIG. 17*c* shows an enlarged detail view from FIG. 17*b* in the transitional area between the setting member 13 and the interlever 9. The adjustment device 8*a* provided for coarse adjustment comprises a rack 37 connected with the interlever 9, which engages an adjustable element 38 with at least one detent tooth 39 (not shown), adjustable by a user. The detent tooth 39 is lifted out of a gap in the rack 17 by torsion of the adjustment device 8*a* and replaced in an adjacent gap. The fine adjustment device 8*b* comprises an eccentric cam 30, where provision is advantageously made that the regulating range of the eccentric cam 30 corresponds to the tooth width of the rack 37, thus enabling a continuous adjustment range of the position of the bearing point of the setting member 13 on the interlever 9.

Figure 18A:
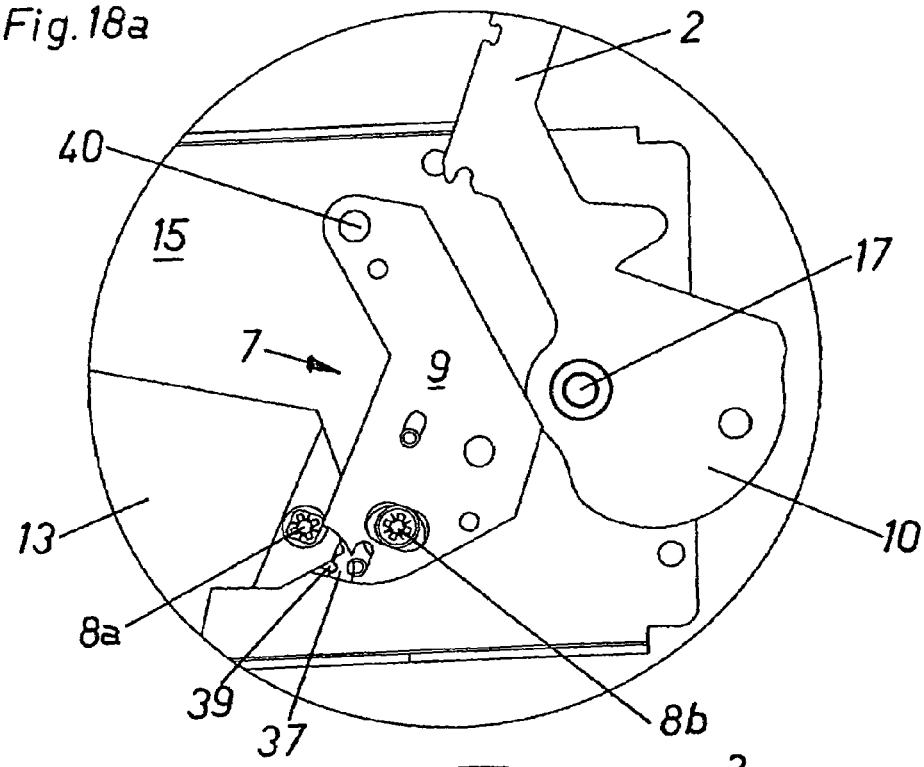
Figure 18B:
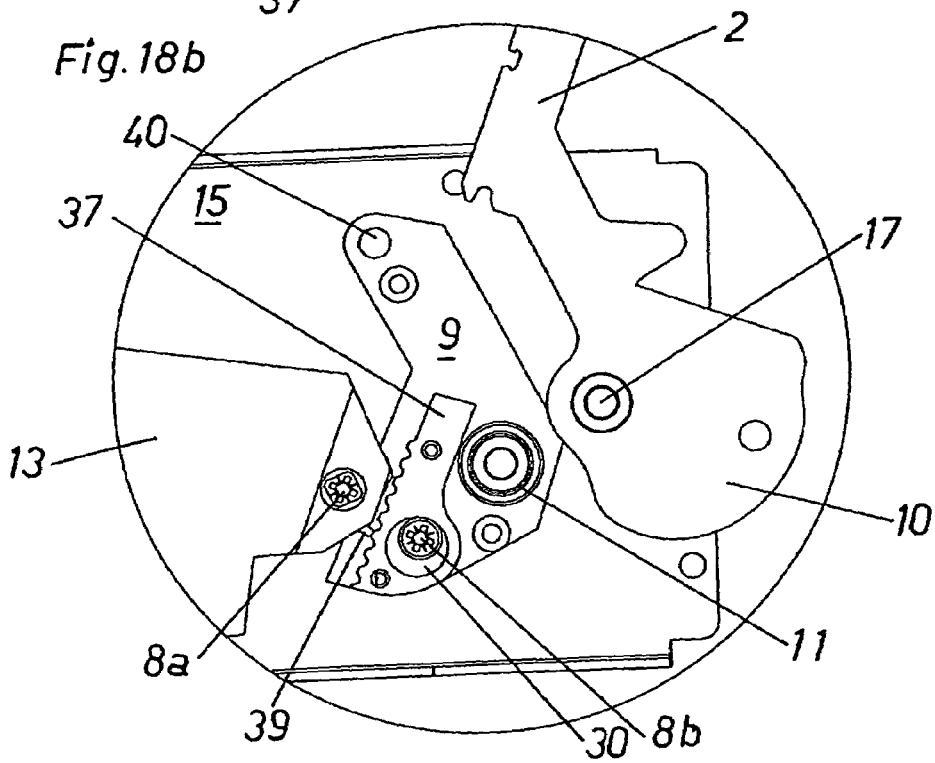

FIG. 18*a* shows a lateral view of the transmission mechanism 7 fixed onto the suspension device 15 from FIGS. 17*a* and 17*b* respectively. FIG. 18*b* shows the same transmission mechanism 7 without cover, so that the internal parts are visible. The spring-loaded setting member 13 is adjustably mounted on the interlever 9. The interlever 9 is pivotably mounted on a fulcrum 40. The actuating arm 2 is in the fully open position so that the control cam 10 of the thrust roller 11 can be brought out of engagement. The detent tooth 39 belonging to the adjustment device 8*a* engages in the rack 37 disposed or formed on the interlever 9. The adjustment device 8*a* is provided for coarse adjustment of the transmission ratio. The adjustment device 8*b* also acts on the rack 37, whereby an eccentric cam 30 alters the position of the bearing point of the setting member 13 on the interlever 9. The adjustment device 8*b* is provided for fine adjustment of the transmission ratio.

Figure 19A:
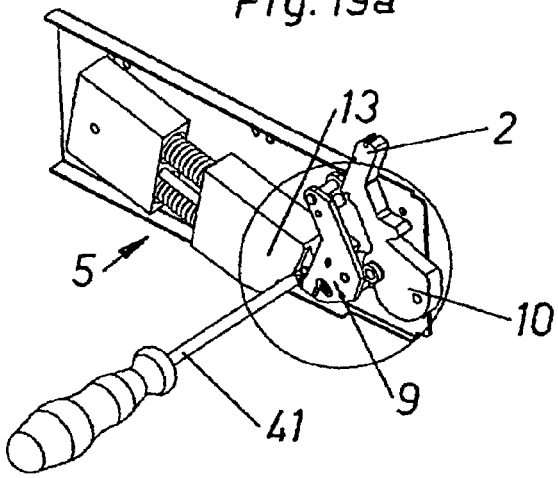
Figure 19B:
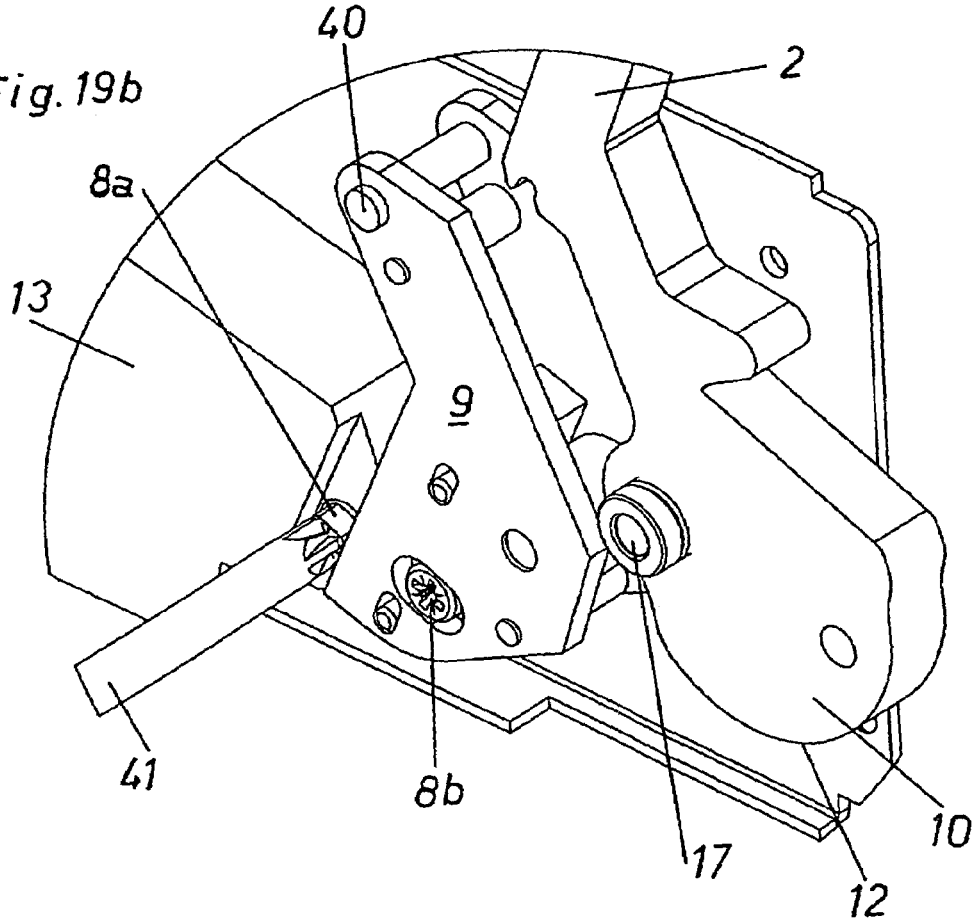

FIG. 19*a* shows the coarse adjustment of the transmission ratio by means of a screwdriver 41, and FIG. 19*b* an enlarged detail view from FIG. 19*a*. The adjustment device 8*a* is actuated with the screwdriver 41 in order to alter the position of the bearing point of the setting member 13 on the interlever 9. In order best to counterbalance the various sizes of the flaps 3 and thus various weights, the force on the setting contour surface 12 of the control cam 10 must be adjustable. By turning the adjustment device 8*a*, this winds down the rack 37, the setting member 13 is lifted out of the toothing at a rotation of 45° and the detent tooth 39 re-engages following a rotation of the adjustment device 8*a* by 90°.

Figures 8A, 8B, 8C, 8D:
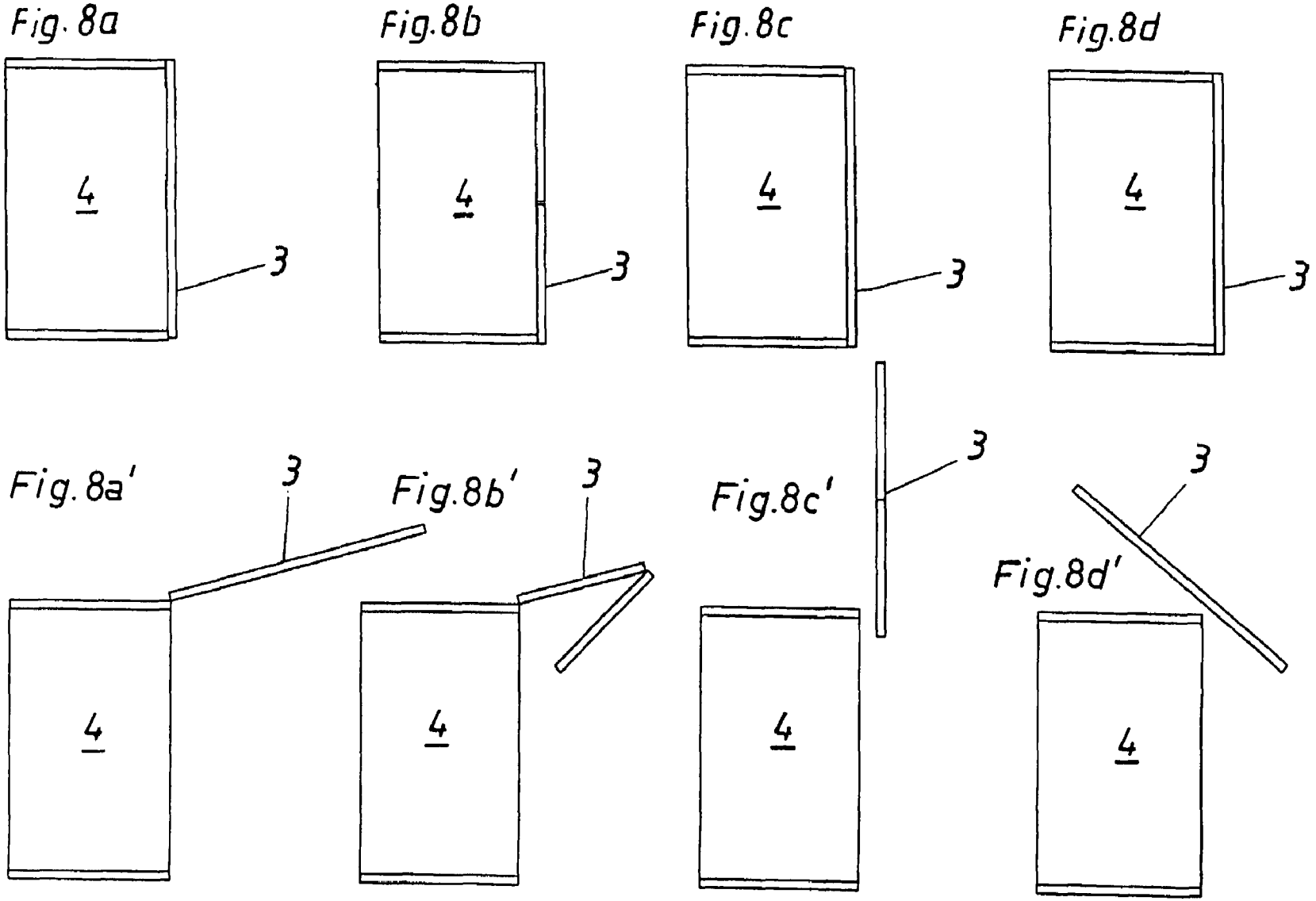
Figure 20A:
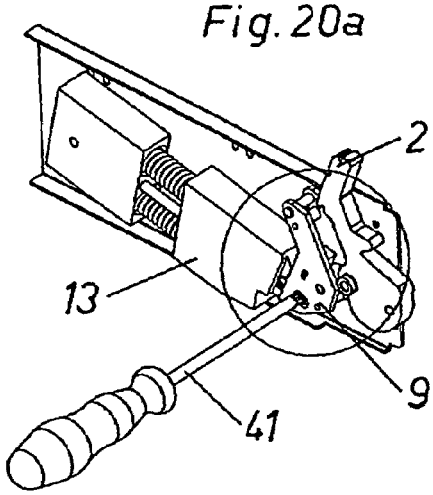
Figure 20B:
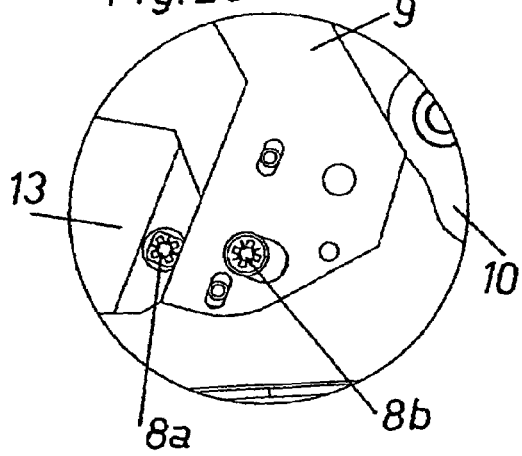
Figure 20C:
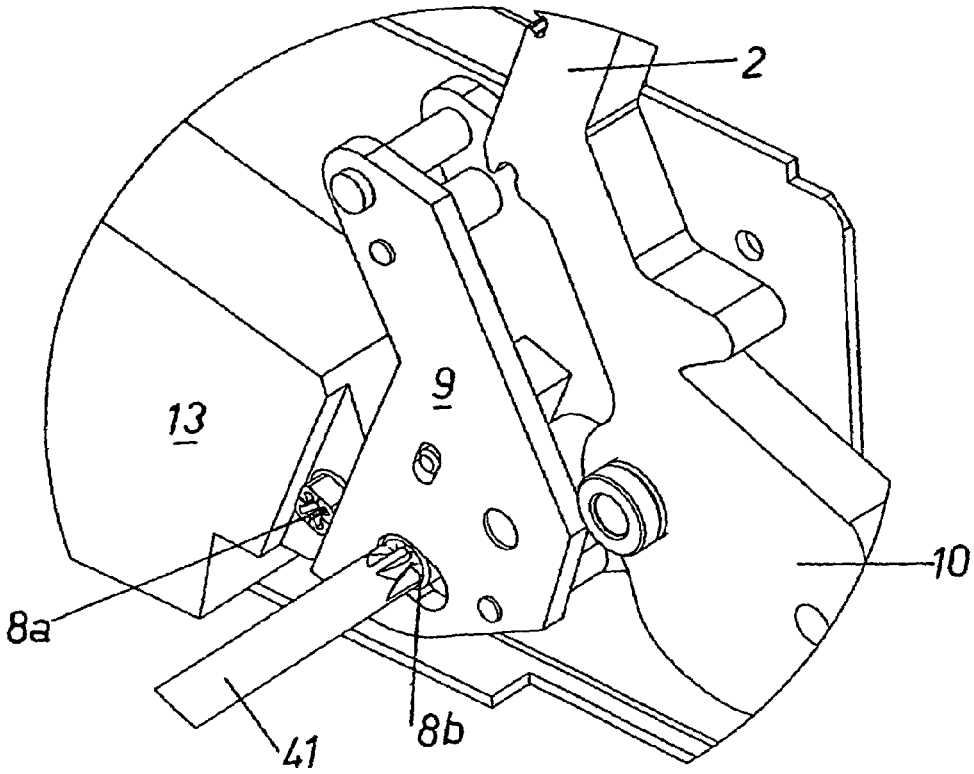

FIG. 20*a* shows the fine adjustment of the transmission ratio using a screwdriver 41, FIG. 8*b* and FIG. 8*c* each showing enlarged detail views. Once the coarse adjustment has been performed as described in FIG. 19*a*, 19*b*, the screwdriver 41 is positioned on the adjustment device 8*b*. This fine adjustment of the transmission ratio occurs via the previously described eccentric cam 30. The area of adjustment of the eccentric cam 30 preferably corresponds to the tooth width of the rack 37. A smooth adjustment of force is possible due to the combination of coarse and fine adjustment.

Figure 21A:
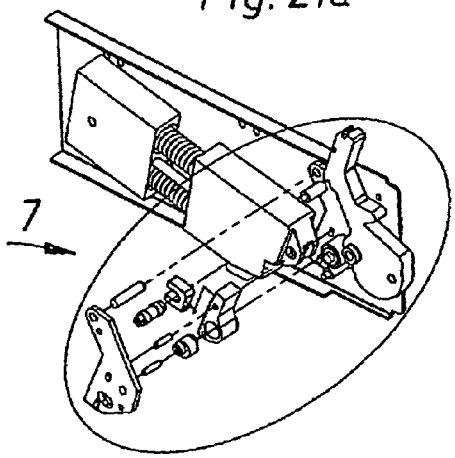
Figure 21B:
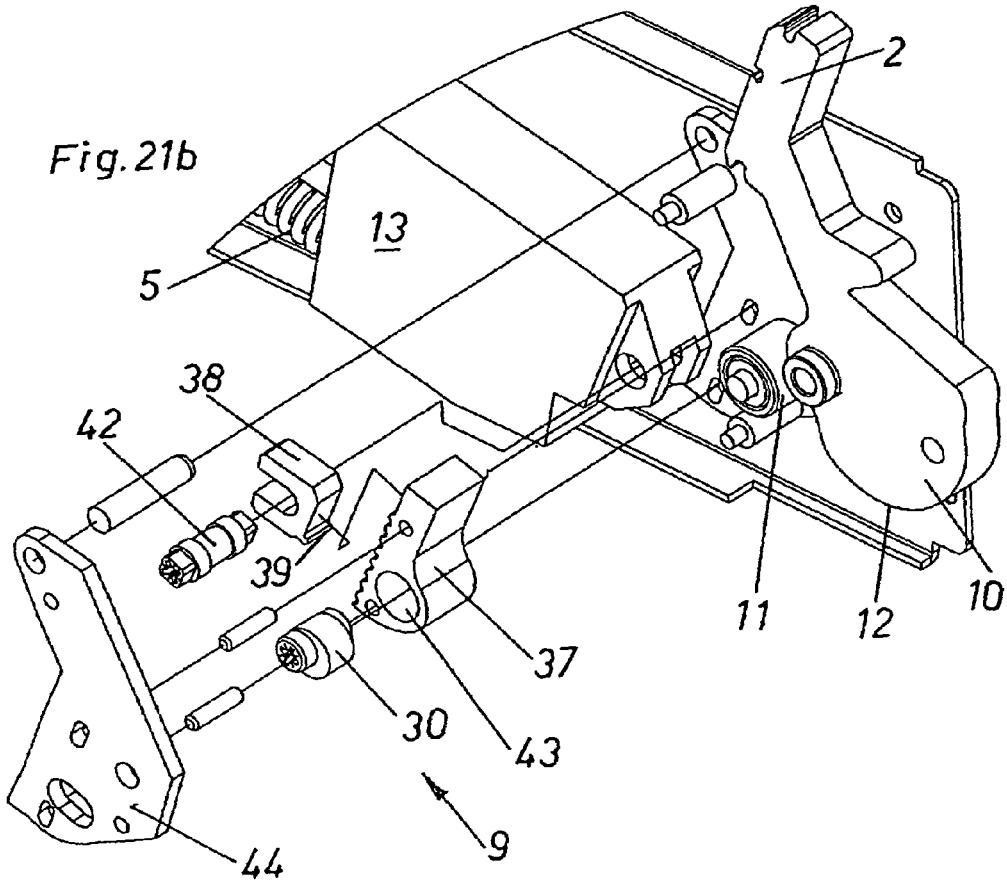

FIG. 21*a* shows an exploded view of the two-stage adjustable transmission mechanism 7 from FIGS. 17 to 20; and FIG. 21*b* shows an enlarged detail view. The setting member 13 loaded by the spring device 5 is displaceably coupled to the rack 37 via the bolt 42 (adjustment device 8*a*) and with the eccentric cam 30 (adjustment device 8*b*). The bolt 42 projects through the adjustable element 38, on which at least one detent tooth 39 is disposed. The eccentric cam 30 projects, in the mounted state, through the opening 43 in the rack 37. By turning the bolt 42 and the eccentric cam 30, the transmission ratio can be varied precisely by a smooth force adjustment. The front end of the interlever 9 forms a cover plate 44.

Figure 22:
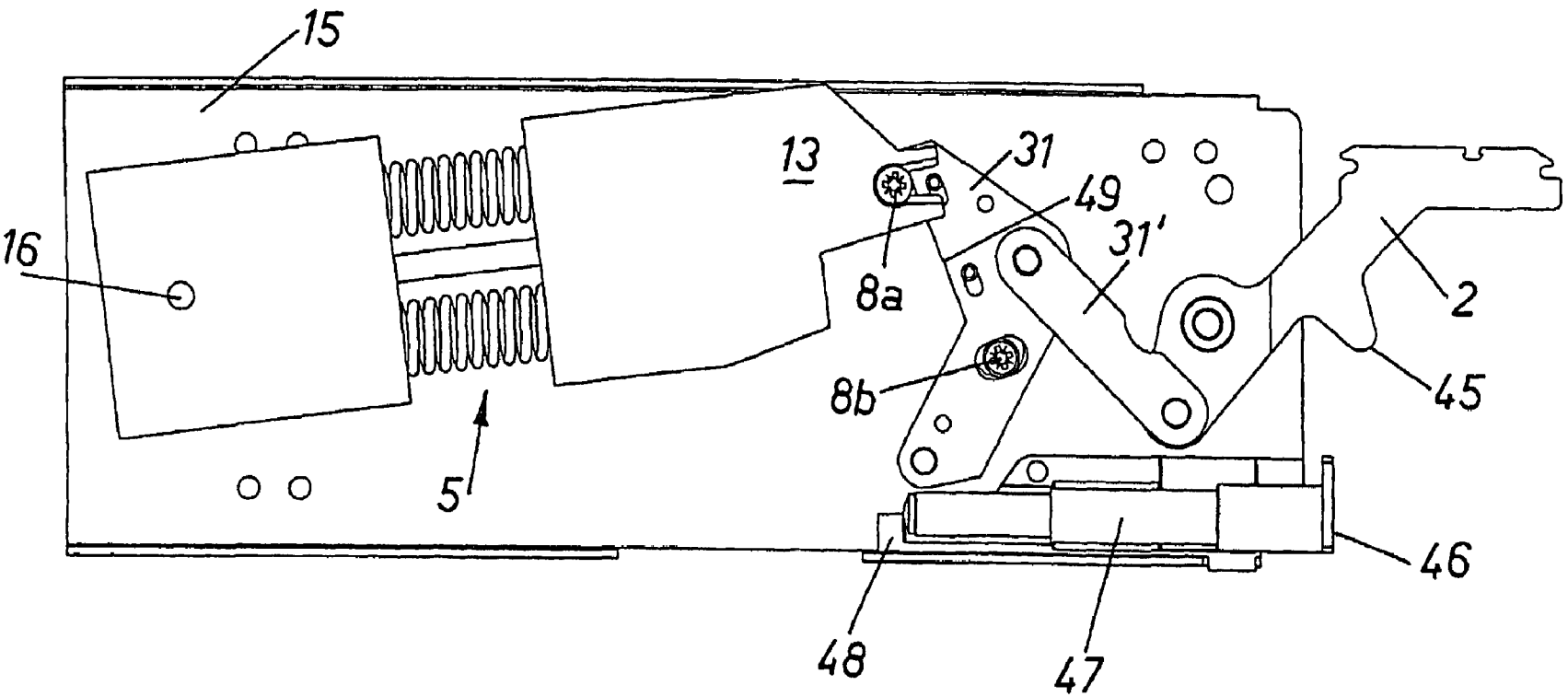

FIG. 22 shows a further embodiment of the invention in a lateral view. Instead of a setting contour 12, the setting member 13 is connected via at least two levers 31, 31', flexibly joined together, with the actuating arm 2. To adjust the transmission ratio, the position of the bearing point of the setting member 13 on at least one of the levers 31, 31' is adjustable. The adjustment devices 8*a* and 8*b* known from FIGS. 17 to 21 are used for coarse and fine adjustment respectively of the transmission ratio. The setting member 13 can be displaced by the adjustment devices 8*a* and 8*b* along the surface 49. To prevent or at least to reduce striking noises when closing the flap 3, a damping device 47 may be provided. Here, for example, a linear damper can be used, which rests on a tab 48 on its side facing away from the flap. On its front end the damping device 47 has a stop 46, which co-operates with a projection 45 disposed or formed on the actuating arm 2 when closing the flap 3. A piston rod connected with the stop 46 is displaced by the projection 45 into the interior of the damping device 47. It is advantageous in this case if a fluid cylinder is provided, but in principle all other damping devices known according to the state of the art can be used (for example rotation dampers).

Figure 23:
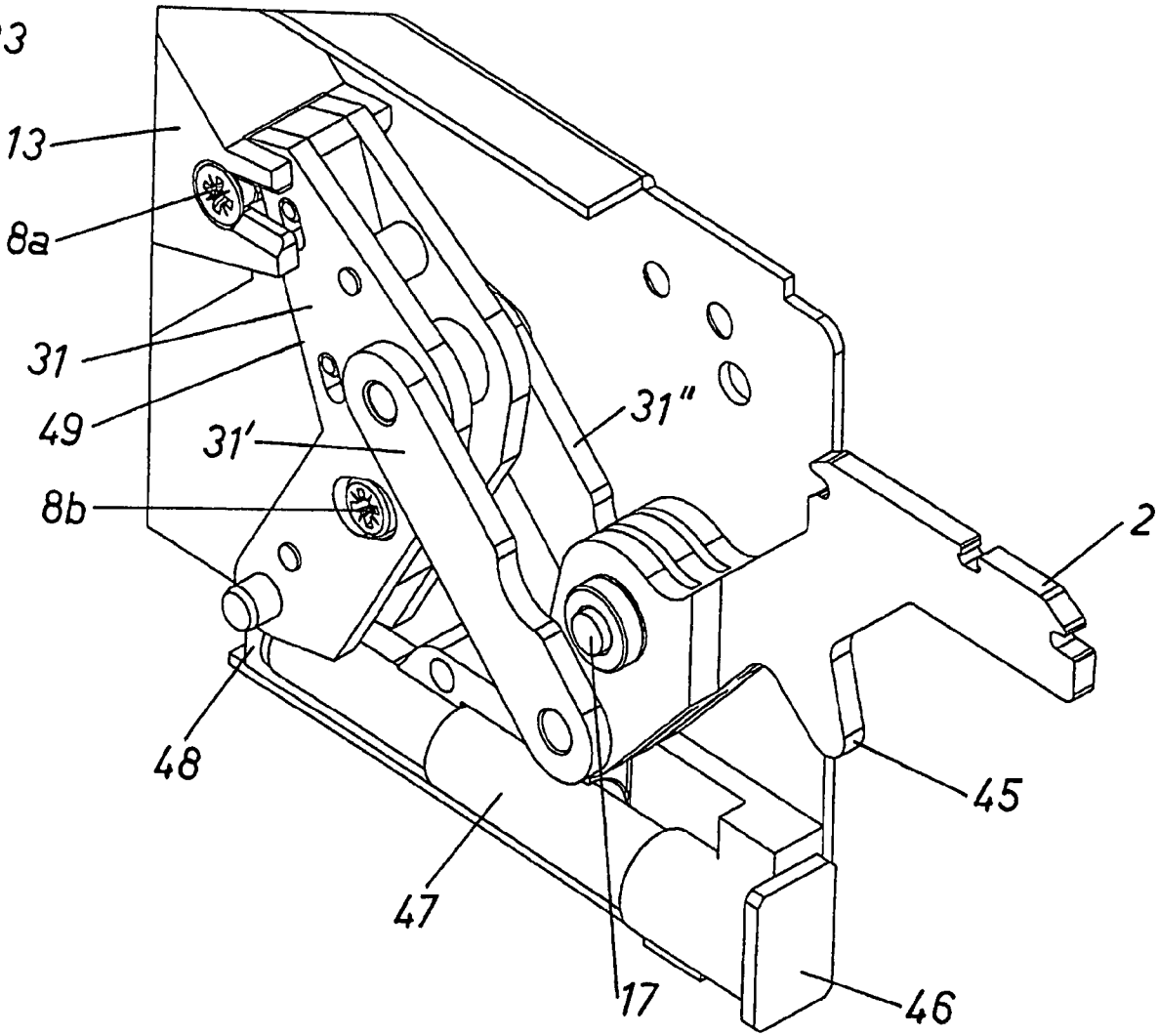

FIG. 23 shows a perspective view of the embodiment from FIG. 22. Two levers 31, 31' are linked to the outside of the lever 31, which are connected with the actuating arm 2 fastened to the axis of rotation 17. Actuation of the adjustment devices 8*a* and 8*b* leads to a change in the position of the setting member 13 on the surface 49 of the lever 31. When the flap 3 is closing, the projection 45 presses against the stop 46 of the damper 47, whereby the final closing path of the flap 3 is damped.

Figure 24A:
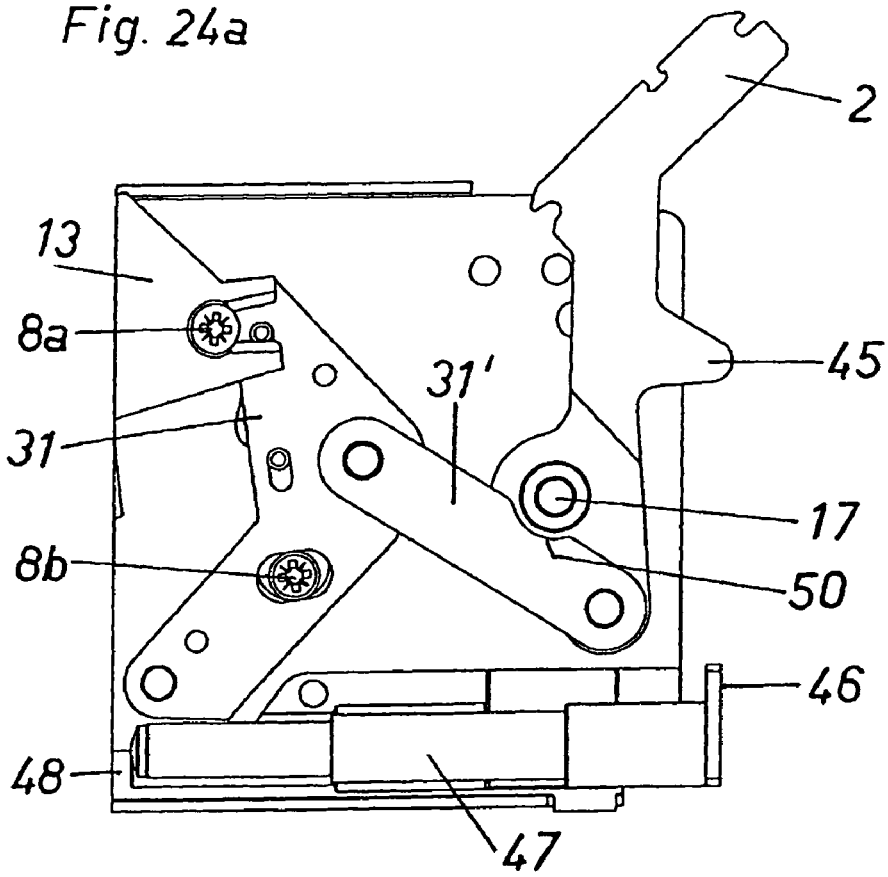
Figure 24B:
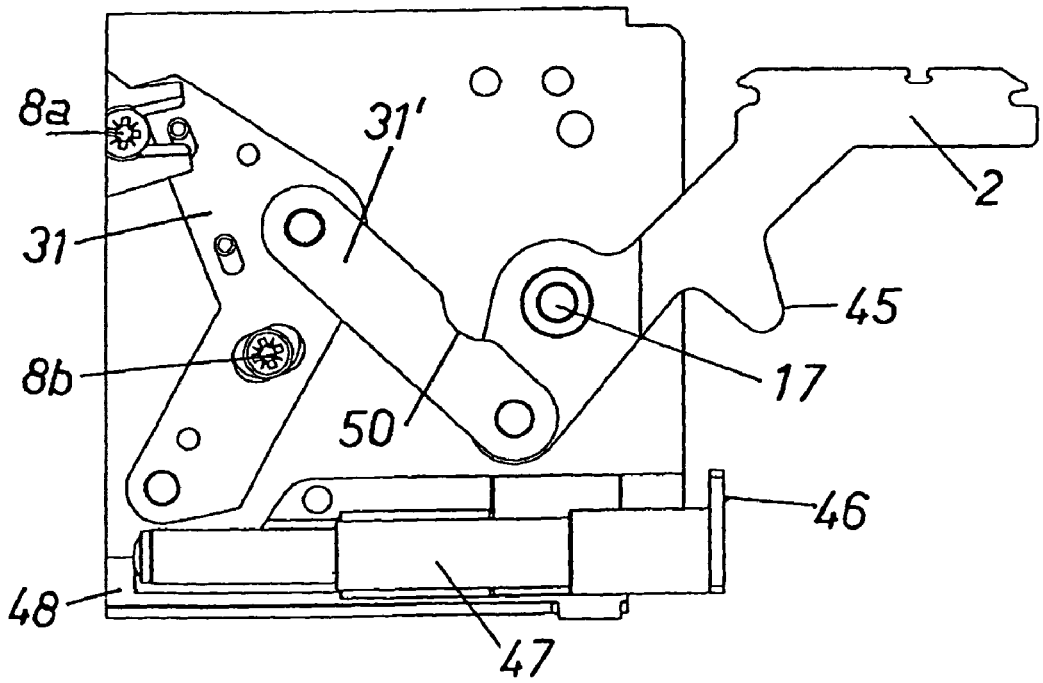

FIG. 24*a* and FIG. 24*b* show the embodiment from FIG. 21 and FIG. 22 respectively in lateral views, where the actuating arm 2 is in the fully open position in FIG. 24*a* and in a half-open position in FIG. 24*b*. To prevent any collision with the levers 31', 31" when the actuating arm 2 is fully open, a cavity 50 is provided on both levers 31', 31". The articulated hinge with the axis of rotation 17 of the actuating arm 2 can be seated, at least partly, in the cavity 50.

The present invention is not limited to the examples shown, but covers or extends to all variants or technical equivalents which may fall within the scope of the following claims. The position details selected in the description, such as for example above, below, lateral etc., relate to the usual mounting position of the actuating mechanism 1 or to the figure directly described and shown, and should be transferred accordingly to the new position, when there is any change in position. The actuating mechanism 1 was realized in the drawings shown as a lever solution. It is, however, equally conceivable and possible to use a toothed wheel variant. It may also be advantageous to dispose the inventive actuating mechanism 1 on both sides of a cupboard-type piece of furniture. In the figures shown, a translational movement or a pivoting movement of the spring-loaded setting member 13 is shown. However, it also lies within the scope of the invention to convert a rotational movement of the setting member 13 (e.g. by a torsion spring) into a pivoting movement of the actuating arm 2, in which case an exact and defined adjustment of the transmission ratio is provided by the adjustment device 8. The invention also makes provision for the inventive actuating mechanism 1 to be used with absolutely identical construction on both side walls (left/right) of a piece of furniture, i.e. without mirror-image components, and with completely identical design thereof.

The invention claimed is:

1. An actuating mechanism for moving a flap of a piece of furniture, said actuating mechanism comprising:

an actuating arm to be pivotably mounted to the flap;

a spring device including a spring-loaded and movable setting member; and a transmission mechanism linked between said spring device and said actuating arm for converting a movement of said setting member into a pivoting movement of said actuating arm, said transmission mechanism including:

an interlever pivotably mounted between said setting member and said actuating arm; and an adjustment device for adjusting a transmission ratio between the movement of said setting member and the pivoting movement of said actuating arm;

wherein one of said interlever and said actuating arm has a setting contour surface, and the other of said interlever and said actuating arm has a thrust roller mounted thereto and arranged to abut against said setting contour surface such that said thrust roller runs along said setting contour surface during the pivoting movement of said actuating arm.

2. The actuating mechanism of claim 1, wherein said actuating arm has said setting contour surface, and said interlever has said thrust roller rotatably mounted thereto.

3. The actuating mechanism of claim 1, wherein said setting contour surface is formed on a cam on one of said interlever and said actuating arm.

4. The actuating mechanism of claim 1, wherein said adjustment device is mounted on said interlever.

5. The actuating mechanism of claim 1, wherein said adjustment device is operable to adjust a position of a bearing point at which said setting member is connected to and acts upon said interlever.

6. The actuating mechanism of claim 1, wherein said adjustment device is operable to adjust a distance between an axis of rotation about which said interlever is operable to pivot and a bearing point at which said setting member is connected to and acts upon said interlever.

7. The actuating mechanism of claim 1, wherein said adjustment device includes a rod, said setting member being displaceably mounted to said rod at a bearing point.

8. The actuating mechanism of claim 7, wherein said rod comprises a threaded spindle, said adjustment device further including an intermediate wheel integrally mounted on said threaded spindle, and a gear wheel engaging said intermediate wheel so as to drive said threaded spindle via said intermediate gear.

9. The actuating mechanism of claim 1, wherein said interlever includes a crank guide, a bearing point at which said setting member acts upon said interlever being movable along said crank guide.

10. The actuating mechanism of claim 1, wherein said spring device comprises at least two compression springs.

11. The actuating mechanism of claim 1, wherein said spring device is adopted to be supported by a body of the piece of furniture via a hinge point.

12. The actuating mechanism of claim 1, wherein said setting member is operable to move linearly.

13. The actuating mechanism of claim 1, wherein said setting member is operable to pivot.

14. The actuating mechanism of claim 13, wherein said spring device has a pivot support for mounting said spring device to a body of the piece of furniture such that said spring device including said setting member are operable to pivot about said pivot support.

15. The actuating mechanism of claim 1, wherein said actuating arm, said spring device, and said transmission mechanism are arranged such that the flap is in a vertical position when closed.

16. A furniture arrangement comprising a movable furniture part and said actuating mechanism of claim 1 connected to said movable furniture part.

17. The furniture arrangement of claim 16, wherein said movable furniture part comprises one of a flap and a door of a piece of furniture.

18. The actuating mechanism of claim 1, wherein said adjustment device comprises one of at least two adjustment devices for adjusting the transmission ratio between the movement of said setting member and the pivoting movement of said actuating arm.

19. The actuating mechanism of claim 18, wherein said at least two adjustment devices are operable to adjust a position of a bearing point at which said setting member is connected to and acts upon said interlever.

20. The actuating mechanism of claim 18, wherein said at least two adjustment devices are operable to differentially vary the transmission ratio between the movement of said setting member and the pivoting movement of said actuating arm.

21. The actuating mechanism of claim 18, wherein a coarse adjustment one of said at least two adjustment devices is operable to provide coarse adjustment of said transmission ratio between the movement of said setting member and the pivoting movement of said actuating arm.

22. The actuating mechanism of claim 21, wherein said coarse adjustment one of said at least two adjustment devices includes a rack for providing the coarse adjustment, said coarse adjustment one of said at least two adjustment devices further including an element adjustable by a user, said element engaging at least one tooth of said rack.

23. The actuating mechanism of claim 18, wherein a fine adjustment one of said at least two adjustment devices is operable to provide coarse adjustment of said transmission ratio between the movement of said setting member and the pivoting movement of said actuating arm.

24. The actuating mechanism of claim 23, wherein said fine adjustment one of said at least two adjustment devices includes an eccentric cam to be operated by a user.

25. The actuating mechanism of claim 24, wherein a coarse adjustment one of said at least two adjustment devices includes a rack for providing coarse adjustment of said transmission ratio between the movement of said setting member and the pivoting movement of said actuating arm, said eccentric cam having a regulating range corresponding to a tooth width of said rack.

26. The actuating mechanism of claim 1, wherein said spring device further includes at least two tension springs.

27. The actuating mechanism of claim 1, wherein said interlever comprises at least two flexibly linked levers, said setting member being connected to said actuating arm via said at least two flexibly linked levers.

28. The actuating mechanism of claim 27, wherein said adjustment device is operable to vary a position of a bearing point of said setting member on at least one of said at least two flexibly linked levers, said bearing point being a point at which said setting member is connected to and acts upon said interlever.

* * * * *